US007946962B2

(12) United States Patent
Long

(10) Patent No.: US 7,946,962 B2
(45) **Date of Patent: *May 24, 2011**

(54) ELLIPTICAL EXERCISE APPARATUS

(75) Inventor: Yun-Bo Long, Songjiang District (CN)

(73) Assignee: Johnson Health Tech Co., Ltd., Taichung Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/650,569

(22) Filed: Dec. 31, 2009

(65) Prior Publication Data

US 2011/0039661 A1 Feb. 17, 2011

(30) Foreign Application Priority Data

Aug. 13, 2009 (TW) ..... 98127351 A

(51) Int. Cl.
*A63B 22/04* (2006.01)
*A63B 23/00* (2006.01)

(52) U.S. Cl. ..... 482/52; 482/148

(58) Field of Classification Search ..... 482/51–57, 482/58–148, 908
See application file for complete search history.

(56) References Cited

U.S. PATENT DOCUMENTS

| | | | | |
|---|---|---|---|---|
| 5,540,637 | A | 7/1996 | Rodgers, Jr. | |
| 6,135,927 | A * | 10/2000 | Lo | 482/57 |
| 6,149,551 | A | 11/2000 | Pyles et al. | |
| 7,462,135 | B2 * | 12/2008 | Lo | 482/52 |
| 2007/0060450 | A1 * | 3/2007 | Lo | 482/52 |
| 2010/0167880 | A1 * | 7/2010 | Long et al. | 482/52 |

FOREIGN PATENT DOCUMENTS

DE 202007011406 U 11/2007

* cited by examiner

*Primary Examiner* — Rinaldi I Rada
*Assistant Examiner* — Robert F Long

(57) ABSTRACT

This invention discloses an elliptical exercise apparatus that is characterized in having left and right tracks disposed in a guider frame which is pivotally coupled to a rear portion of the elliptical exercise apparatus. When a user uses the elliptical exercise apparatus, the guider frame is at a use position. When the user folds the elliptical exercise apparatus, the guider frame is at a storage position. A user can complete folding procedure merely by operating the guider frame.

6 Claims, 19 Drawing Sheets

ELLIPTICAL EXERCISE APPARATUS

CROSS-REFERENCE TO RELATED APPLICATION

This application claims priority of Taiwan Invention Patent Application No. 098127351, filed on Aug. 13, 2009.

BACKGROUND

1. Field of the Invention

This invention relates to a stationary exercise apparatus and, more particularly to a folding elliptical exercise apparatus.

2. Description of the Related Art

Elliptical exercise apparatus is a kind of stationary exercise machine. It has left and right pedals for supporting left and right feet of a user and can guide the user to exercise along an elliptical closed path, simulating jogging or running. For example, U.S. Pat. No. 5,540,637 discloses a typical elliptical exercise apparatus. The embodiment thereof has left and right supporting members for supporting the left and right pedals. The front end of each left and right supporting members is coupled to a crank for moving along a circle path. The rear end thereof is coupled to a track to perform linearly reciprocating movement. The left and right pedals, therefore, are driven to move along an elliptical closed path.

Preferably, the user may want the elliptical exercise apparatus to be folded up when he/she wants to store the elliptical exercise in order to save some space. The applicant of the present invention disclosed a folding elliptical exercise apparatus in U.S. Pat. No. 6,149,551. Front ends of left and right rails therein are independently pivoted to the frame, rear ends of the left and right rails are respectively equipped with caps. Each bottom side of left and right supporting members is arranged with a lock. Each of the rails and supporting members can be independently rotated about its front end in a vertical plane relative to the ground surface. When the user wants to fold up the elliptical exercise apparatus, the left and right supporting members can be rotated upward first. Then, the left and right rails can also be rotated upward about 90 degrees to engage the caps into the locks which are bolted on the bottom surfaces of left and right supporting members. Therefore, the rails and the supporting members are at a substantial vertical position, and the elliptical exercise apparatus at such storage status has a smaller footprint comparing to a using status.

The folding elliptical exercise apparatus of U.S. Pat. No. 6,149,551, however, still has some aspects which can be improved better. Firstly, to facilitate the folding process, the user has to make a crank stop at a particular angle so that the caps of the left and right rails and locks of left and right supporting members can be successfully joined together. Otherwise, if the supporting member are rotated upward regardless the crank position, the rear end of the corresponding rail usually can not engage to the bottom surface of the supporting member correctly. In this situation, the user has to either lower the rail and supporting member to restart again or grasp the supporting member to force the crank to rotate. Secondly, the left and right sides of the elliptical exercise apparatus have to be folded separately. In other words, the user must operate the same steps twice to complete the folding process. During the folding process, the rear ends of the supporting members can not be continuously supported by the rails because of insufficient length of the rails.

DE 202007011406 discloses a folding elliptical exercise apparatus. In order to make the rear ends of supporting members be always supported or coupled to the corresponding tracks at both use and storage positions, the elliptical exercise apparatus thereof has telescopic tracks. The rear ends of the supporting member are higher than the rear ends of the tracks after folding. If a user wants to fold the elliptical exercise apparatus to the storage position, he must elongate the left and right tracks. Steps of folding process are inconvenient. The telescopic tracks are also complicated to manufacture and expensive.

U.S. Pat. No. 7,462,135 adopts familiar mechanical components which are often used in treadmill in elliptical exercise apparatus. During folding process, not only supporting members, pedals, and tracks but also crank mechanisms, pulleys, flywheel, and resistance assembly are moved together. Therefore, the user nearly has to take the whole weight of the elliptical exercise apparatus.

SUMMARY

The present invention involves a folding elliptical exercise apparatus. Generally speaking, the present invention makes the footprint of the elliptical exercise apparatus much compact after folding and without complicating the structures thereof to achieve the folding function. Besides, a user can quickly, conveniently, safely, and effort-saving operate the folding or unfolding procedures.

According to the present invention, a folding elliptical exercise apparatus substantially includes a main frame rested on a ground surface, a crank assembly connected to the main frame, a guider frame which has tracks thereon pivotally coupled to a rear portion of the main frame at a pivot axis positioned at a height relative to the ground surface so that the guider is movable between a use position and a storage position, left and right supporting members respectively interconnected between the crank assembly and the guider frame, and left and right pedals respectively coupled to the left and right supporting members. When the guider frame is at the use position, a user can use the folding elliptical exercise apparatus. When the guider frame is at the storage position, the elliptical exercise apparatus is folded and the portions of the left and right supporting members originally connected to the guider frame as the use position are still both coupled to the guider frame.

In the present invention, the user can fold or unfold the elliptical exercise apparatus simply by operating the guider frame. Furthermore, even the length of the tracks are only sufficient to provide the left and right supporting members to do normal reciprocating movement required as exercise, the guider frame can be lifted up at least 60 degrees. That is, the projecting area of the guider frame on the ground surface is significantly reduced to half.

This summary is not meant to be exhaustive. Further features, aspects, and advantages of the present invention will become better understood with reference to the following description, accompanying drawings and appended claims

DETAIL DESCRIPTION

Figure 1:
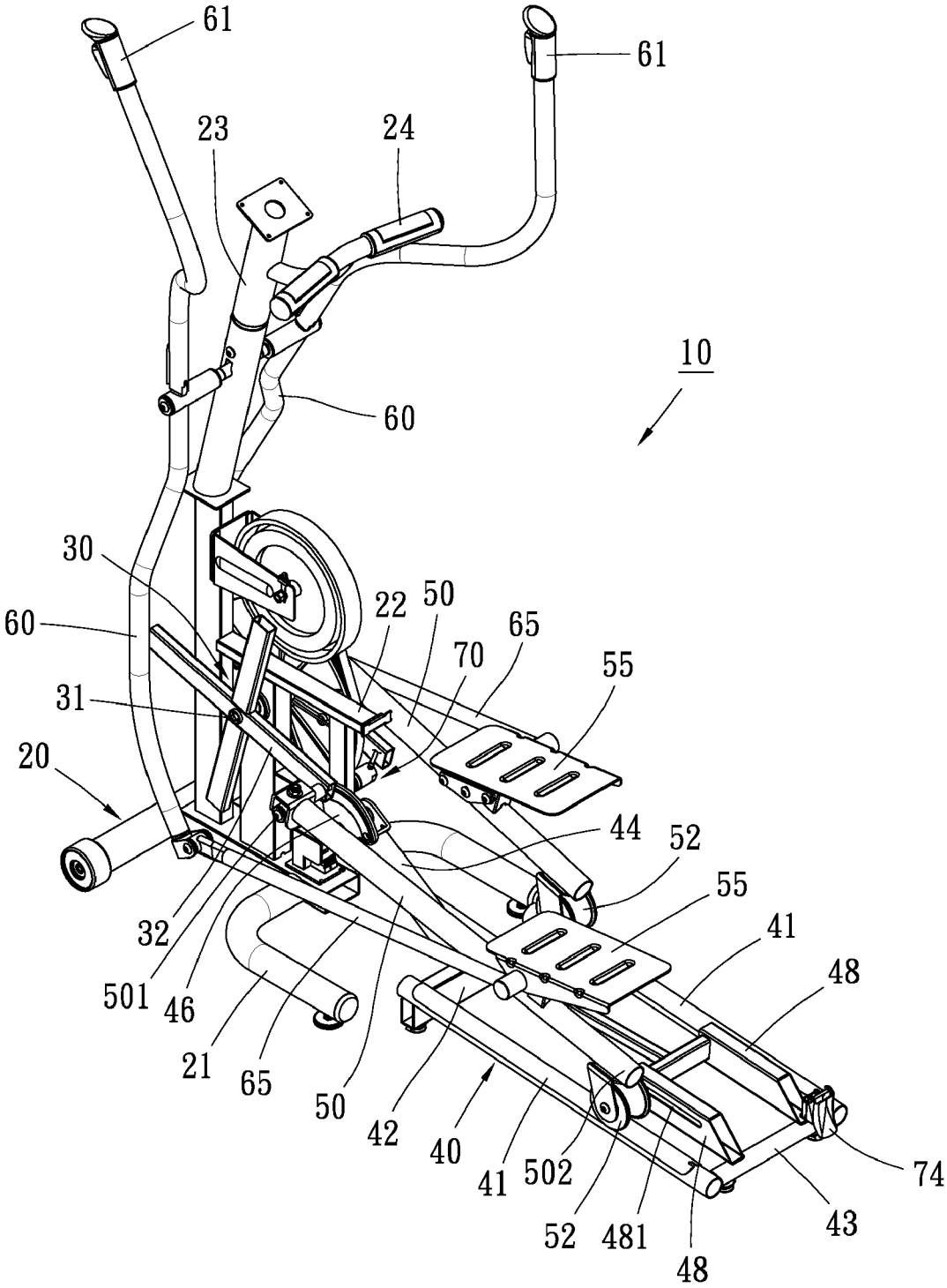
FIG. 1 is a perspective view of a first embodiment of a folding elliptical of the present invention at a use position.

Referring now specifically to the figures, in which identical or similar parts are designated by the same reference numerals throughout, a detailed description of the present invention is given. It should be understood that the following detailed description relates to the best presently known embodiment of the invention. However, the present invention can assume numerous other embodiments, as will become apparent to those skilled in the art, without departing from the appended claims.

Figure 2:
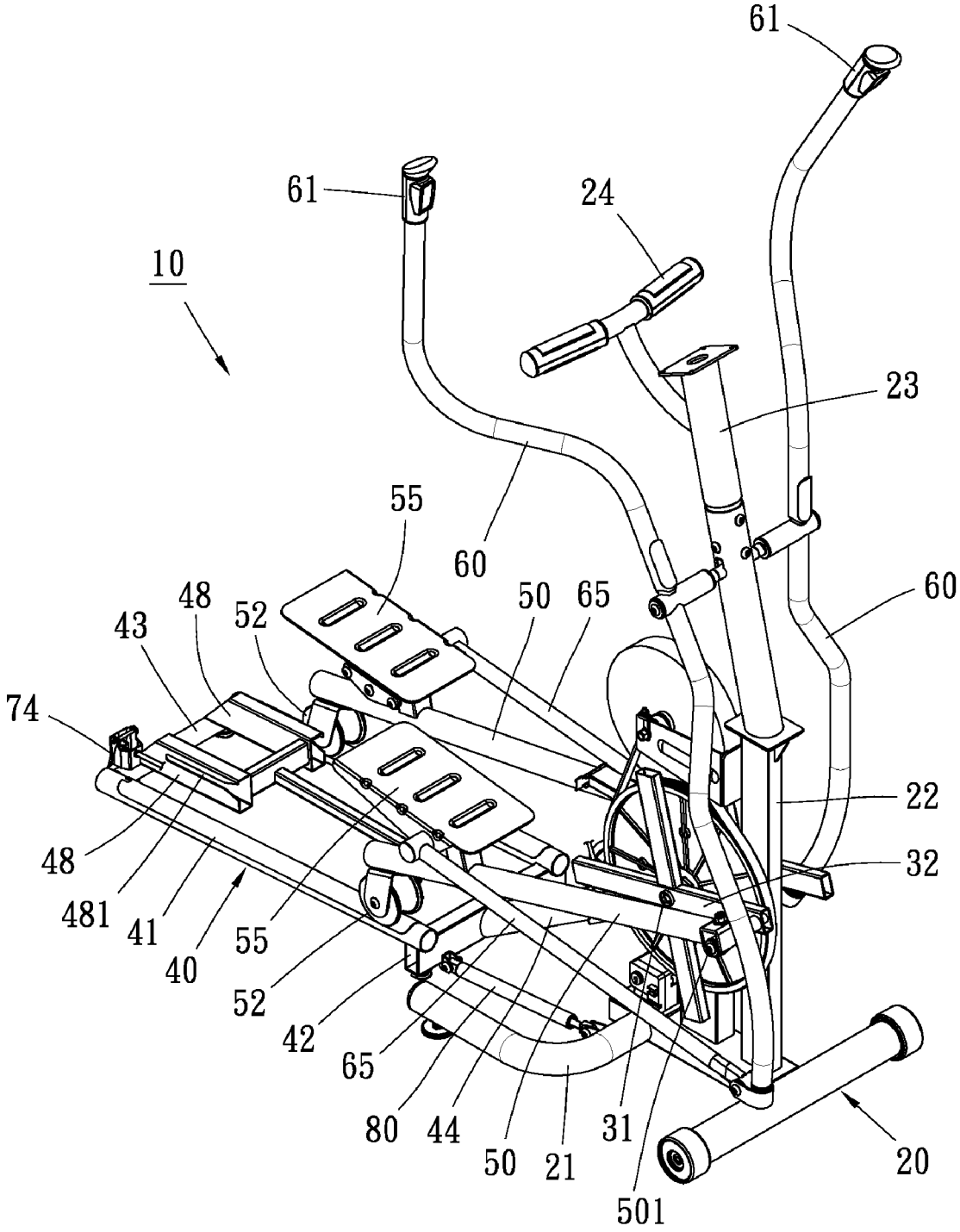
FIG. 2 is another perspective view of the folding elliptical exercise apparatus of FIG. 1.
Figure 4:
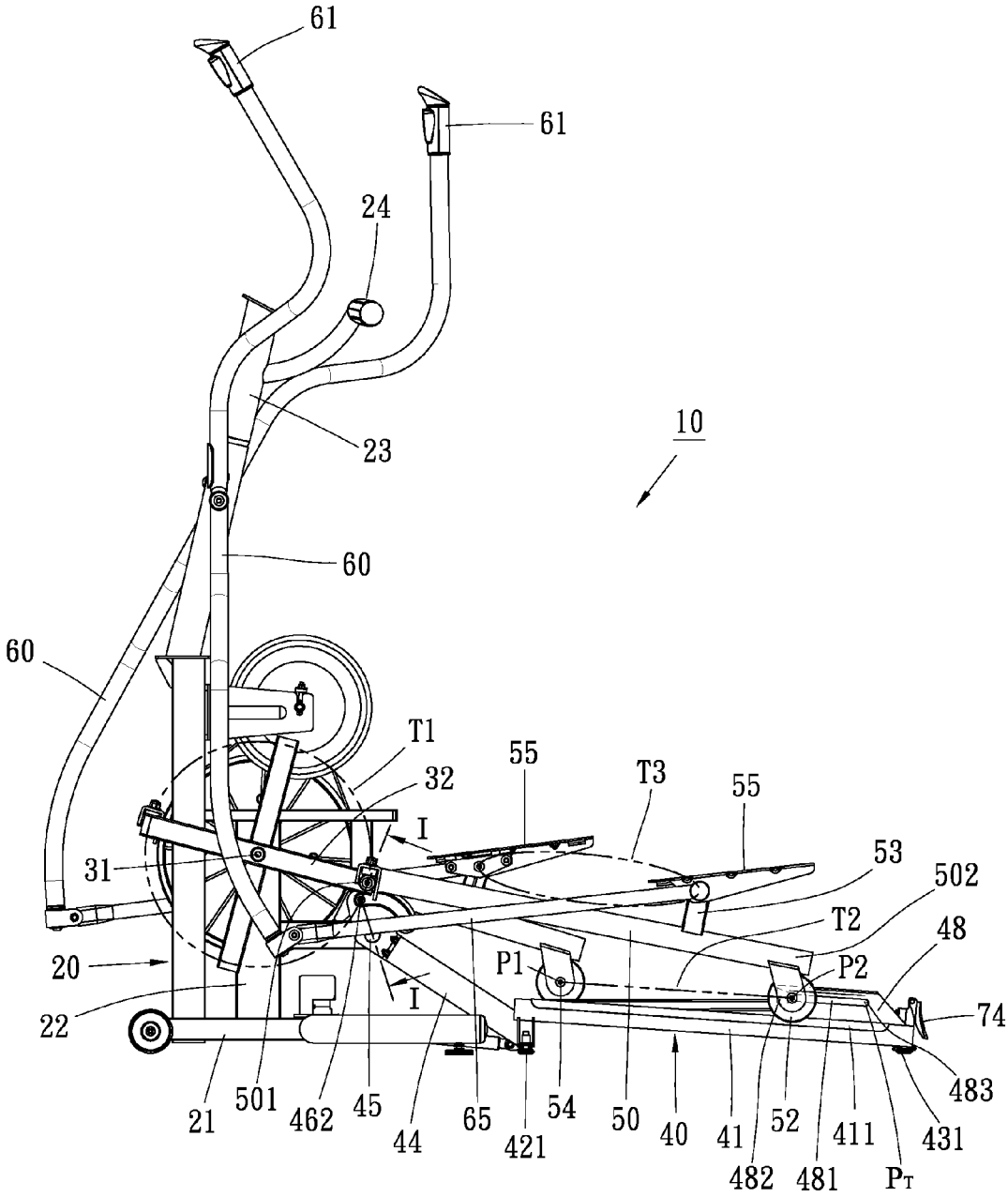
FIG. 4 is a left side view of the folding elliptical exercise apparatus of FIG. 1.

Referring to FIGS. 1, 2, and 4, the first embodiment of the present invention is an elliptical exercise apparatus 10. The embodiment includes a main frame 20 rested on a ground surface, a crank assembly 30 connected to the main frame 20, a guider frame 40 operably connected to a rear portion of the main frame 20, left and right supporting members 50 respectively interconnected between the crank assembly 30 and the guider frame 40, left and right pedals 55 respectively coupled to the left and right supporting members 50, left and right handle links 60 respectively coupled to a left and right sides of the main frame 20, and left and right control links 65 respectively coupled between the left and right handle links 60 and the left and right pedals 55.

The main frame 20 provides a stable foundation for other mechanical parts of the elliptical exercise apparatus 10. The main frame 20 includes a base 21 rested on the ground surface, a rack 22 mounted on the base 21, and a post 23 mounted on a top portion of the rack 22. There is a handgrip 24 mounted on a top portion of the post 23 for a user to grip as exercising. In addition, as prior elliptical exercise apparatus, the embodiment can also be equipped with a control console (not shown) on the top end of the post 23.

The crank assembly 30 includes a crank unit 32 rotatably coupled to the rack 22 at a first axis 31 which is laterally disposed. In addition to the crank assembly 30, there are several pulleys, pulley-belts, flywheel, and resistance assembly which are belong to a driving system of the embodiment and connected to the rack 22 as prior elliptical exercise apparatus. Because these mechanical components of the driving system are known by people skilled in the art and the driving system is minor among mechanical parts of the embodiment of the present invention, the details of the driving system are not described herein.

Figure 5:
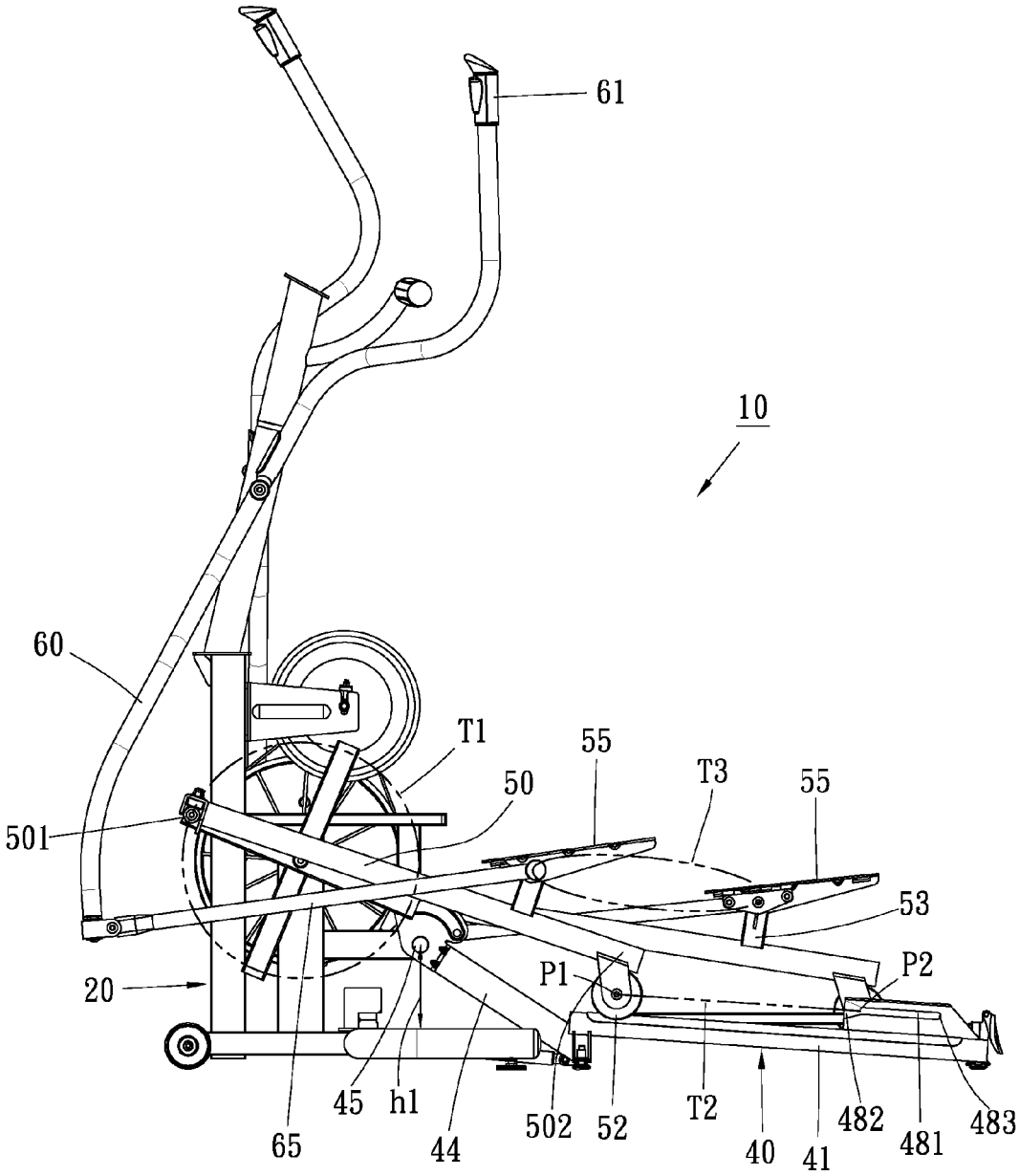
FIG. 5 is another left side view of the folding elliptical exercise apparatus wherein the left roller is positioned at an opposite point relative to FIG. 4.
Figure 6:
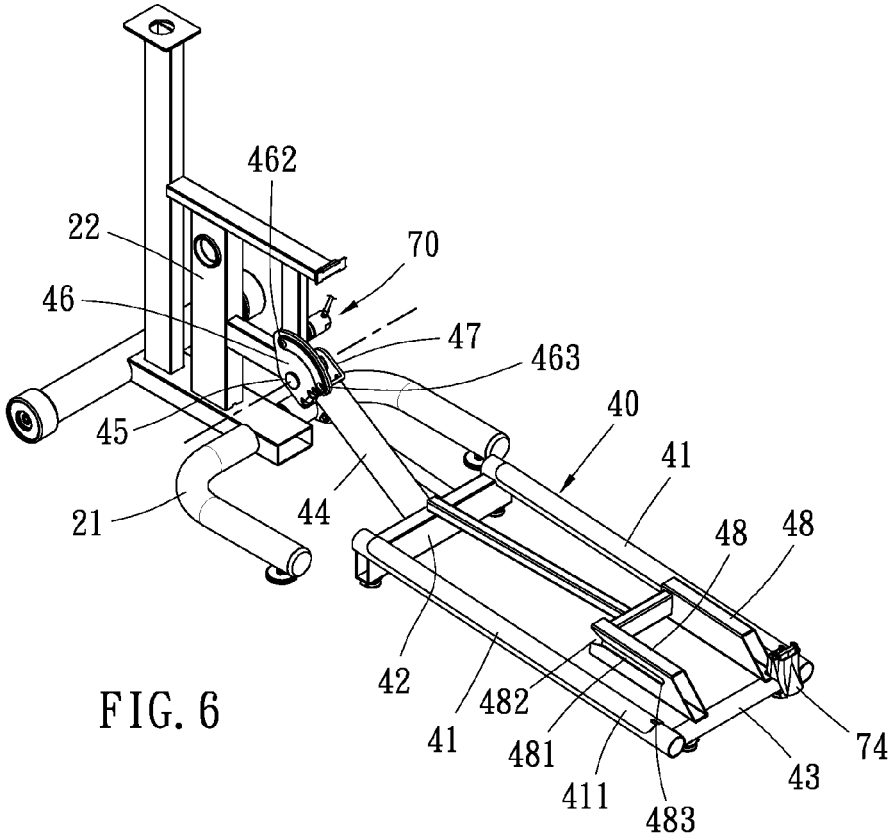
FIG. 6 is a schematic perspective view of the folding elliptical exercise apparatus which shows mechanical connecting relationship between a frame and a guider frame of the first embodiment of FIG. 1 wherein the guider frame is at a use position.
Figure 7:
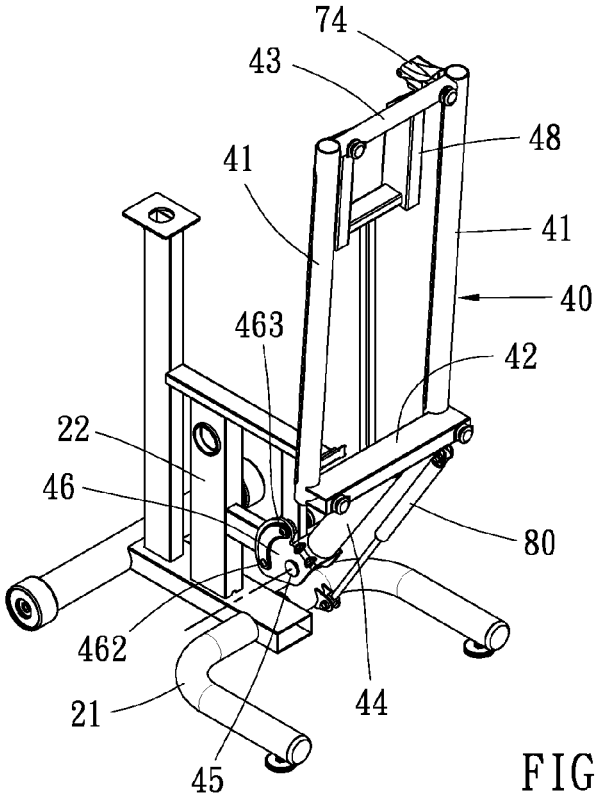
FIG. 7 is also a schematic perspective view of the folding elliptical exercise apparatus which shows mechanical connecting relationship between the frame and the guider frame of the first embodiment of FIG. 1 wherein the guider frame is at a storage position.

Referring to FIGS. 5-7, the guider frame 40 includes left and right tracks 41 which are disposed longitudinally and parallel each other. Each of the left and right tracks 41 has a front end and a rear end. There is a front rod 42 interconnected between the front ends of the left and right tracks 41, and a rear rod 43 interconnected between the rear ends of the left and right tracks 41. Therefore, the front rod 42, the rear rod 43, and the left and right tracks 41 form a rectangle to fix the left and right tracks 41. An arm 44 is mounted on the middle portion of the front rod 42 and extending upward and forward to be pivoted to the rack 22 at a pivot axis 45. The pivot axis 45 is located at a first height h1 relative to the base 21 of the main frame 20. Thus, the longitude of the arm 44 has an included angle relative to the plane of the left and right tracks 41. The guider frame 40 can be lifted or folded up to be at a storage position as shown in FIG. 7 or lowered to be at a use position as shown in FIG. 6. In other words, the guilder frame 40 can be rotated on the pivot axis 45.

Figure 12:
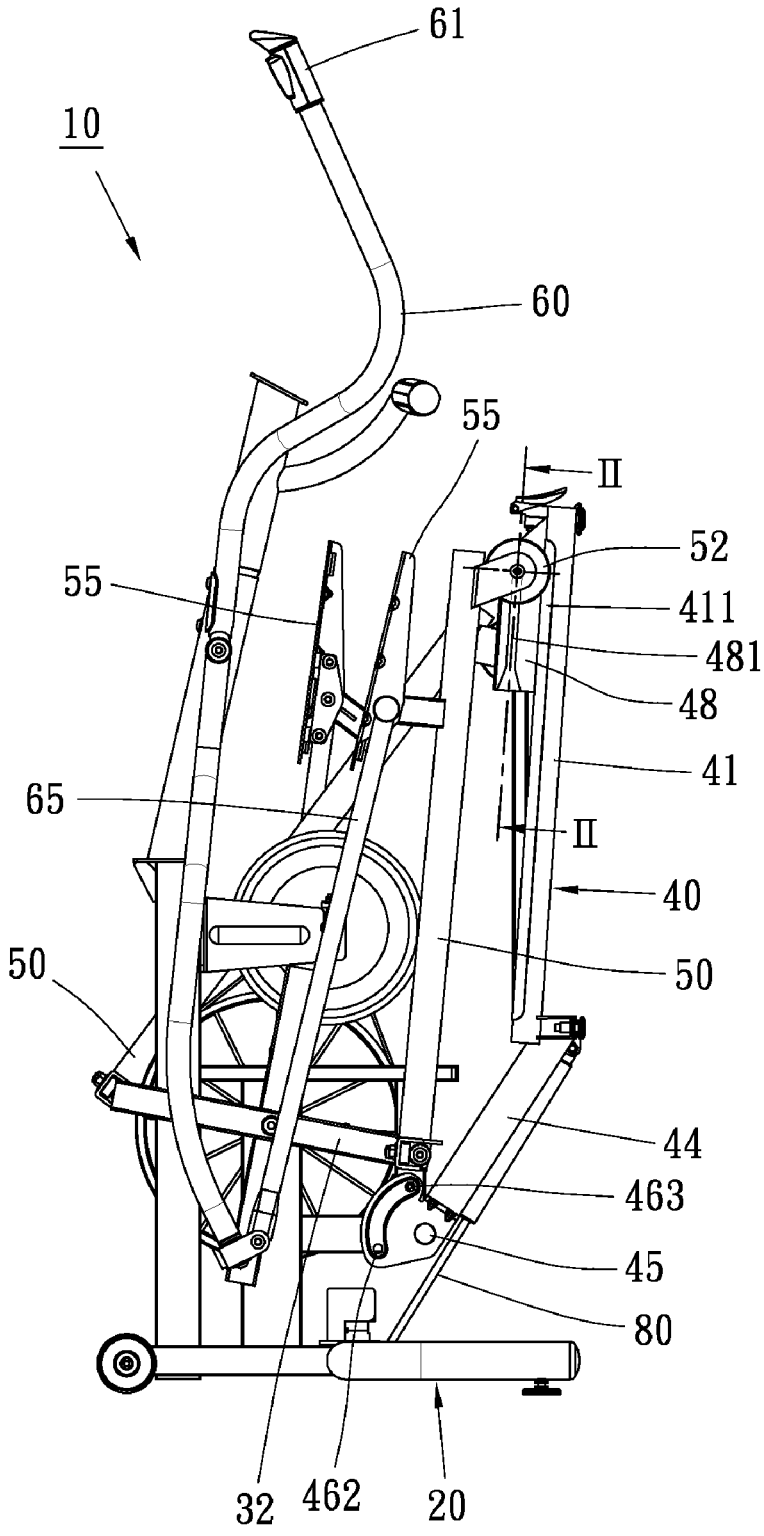
FIG. 12 is a left side view of the folding elliptical exercise apparatus which is at the storage position wherein a crank thereof is at a position which can not be rotated counterclockwise.

As depicted in FIG. 4, when the guider frame 40 is at the use position, first pads 421 under the front rod 42 and second pads 431 under the rear rod 43 are rested on the ground surface. Therefore, the left and right tracks 41 are substantially parallel to the ground surface. Practically, the fronts of the left and right tracks 41 are slightly higher than the rears thereof (the left and right tracks 41 has an angle of elevation about four degrees relative to the horizontal). However, the small angle of ascent or descent does not effect the present invention. Referring to FIG. 12, when the guider frame 40 is at the storage position, the left and right tracks 41 are substantially perpendicular to the ground surface. In the embodiment, an angle of the guider frame 40 between the use position and the storage position are about ninety degrees.

Figure 8:
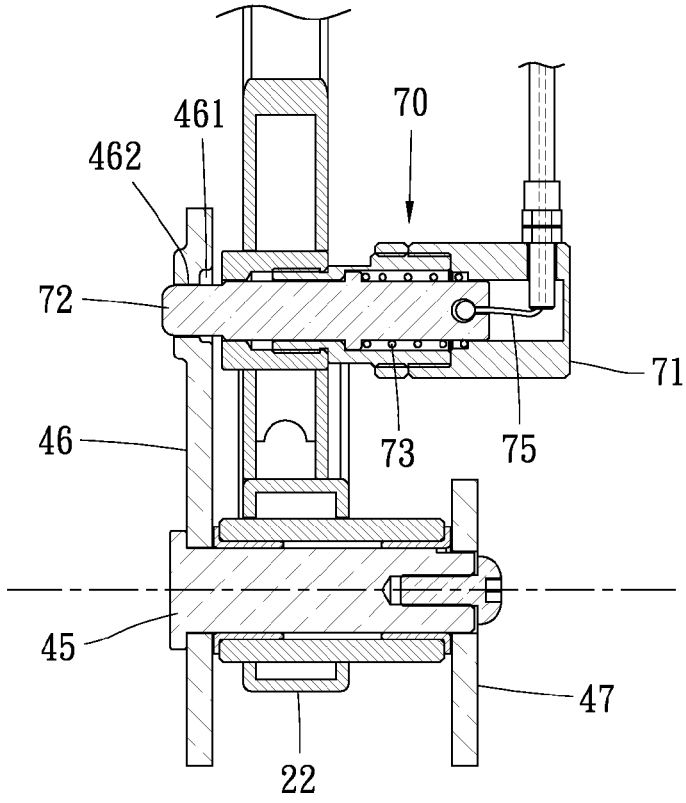
FIG. 8 is a cutaway view of the folding elliptical exercise apparatus about the I-I axis of FIG. 4.

Referring to FIG. 8, the arm 44 of the guider frame 40 further includes left splint 46 and right splint 47 which are mounted on the front of the arm 44 and parallel to each other. The left splint 46 and right splint 47 are clipped to the rear portion of the rack 22 of the main frame 20. An axle of the pivot axis 45 is penetrated through the left splint 46, the rack 22, and the right splint 47. The shape of the left splint 46 is a sector with the pivot axis 45 as the center of the circle. The left splint 46 also has an arc groove 461 with the pivot axis 45 as the center. The arc groove 461 is arranged near the arc edge of the left splint 46. The radian of the arc groove 461 is slightly more than ninety degrees. Different from the arc groove 461, the distal ends of the arc groove 461 are hollowed holes penetrating the left splint 46 to form a first locking hole 462 and a second locking hole 463 as illustrated in FIG. 6 and FIG. 7. The first locking hole 462 and second locking hole 463 also have an included angle of about ninety degrees with the pivot axis 45 as the center. A locking mechanism 70 is disposed at a position of the rack 22 corresponding to the position of the arc groove 461. Referring to FIG. 8, the locking mechanism 70 substantially includes a cylinder shell 71, a first pin 72, and a compressed spring 73. The first pin 72 is coaxially arranged in the cylinder shell 71, but the left end of the first pin 72 is outside of the cylinder shell 71. The first pin 72 can be horizontally moved within a limited range along the longitudinal axis thereof. Two distal ends of the compressed spring 73 respectively push the first pin 72 and the cylinder shell 71, and the elasticity of the compressed spring 73 biases the first pin 72 to move leftward. When the guilder frame 40 is rotated to the use position or the storage position, the compressed spring 73 can bias the first pin 72 to move leftward and make the left end of the first pin 72 penetrate through the left splint 46 to engage with the first locking hole 462 or the second locking hole 463. Therefore, the guilder frame 40 can be locked at the use position or the storage position.

Figure 9:
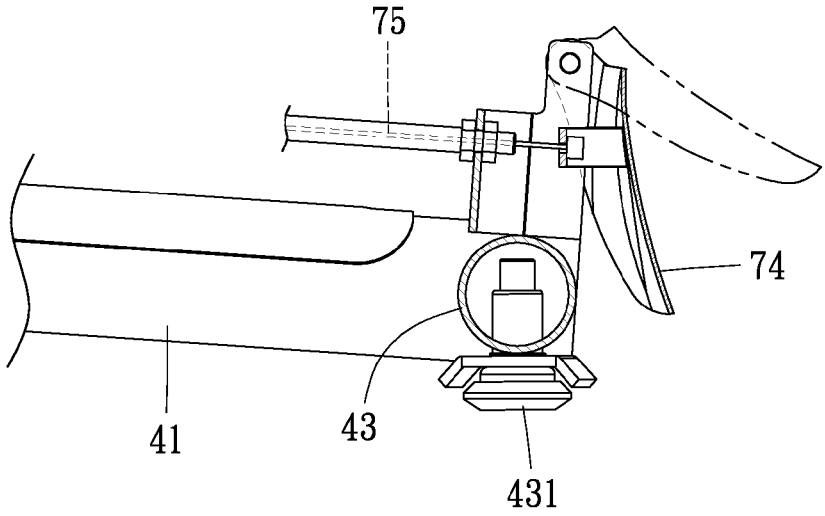
FIG. 9 is a schematic cross-sectional vertical view of a locking mechanism of the folding elliptical exercise apparatus.

Referring to FIG. 9, there is a switch 74 coupled to the rear portion of the right track 41 of the guider frame 40. A steel cable 75 is interconnected between the first pin 72 of the locking mechanism 70 and the switch 74. When the first pin 72 is at a locking position as shown in FIG. 8, the switch 74 is pulled by the steel cable 75 as shown in actual line in FIG. 9. When the user turns the switch 74 to be at a position as shown in dotted line in FIG. 9, the user's force via the steel cable 75 pulls the first pin 72 out of one of the first locking hole 462 and second locking hole 463. Then, the guider frame 40 can be freely rotated.

Each of the left and right supporting members 50 has a first end portion 501 and a second end portion 502. The first end portions 501 of the left and right supporting members 50 are respectively jointed or coupled to the crank unit 32 to rotate on the first axis 31 around a first closed path T1. The second end portions 502 of the left and right supporting members 50 are respectively connected with left and right rollers 52 and respectively engaged with the left and right tracks 41. The second end portions 502 of the left and right supporting members 50 are capable of moving along the left and right tracks 41 of the guider frame 40. As illustrated in FIG. 4 and FIG. 5, there are space members 53 respectively mounted on portions between the middle portions and the second end portions 502 of the left and right supporting members 50. When the guider frame 40 is at the use position and the first end portions 501 of the left and right supporting members 50 are rotated around the first closed path T1, the second end portions 502 of the left and right supporting members 50 are correspondingly moved along a reciprocating path T2. At the same time, the top ends of the space members 53 are respectively moved around an elliptical-like closed path T3.

The left and right pedals 55 are respectively pivotally coupled to the space members 53 with front portions thereof. Therefore, each of the front portions of the left and right pedals 55 is guided to move along the elliptical-like closed path T3 and rear portions of the left and right pedals 55 can be tilted up or down relative to the corresponding front portions of the left and right pedals 55.

The left and right handle links 60 are respectively laterally coupled to the left and right sides of the post 23 of the main frame 20 with middle portions thereof. A top portion and a bottom portion of the same handle link 60 can be swung forward or backward relatively. The top portions of the left and right handle links 60 are provided as gripping portions 61 for the user. The left and right control links 65 are respectively interconnected between the bottom portions of the left and right handle links 60 and the left and right pedals 55.

As shown in FIG. 1 to FIG. 4, when the guider frame 40 is at the use position, the user can operate the elliptical exercise apparatus 10. As depicted in FIG. 4 and FIG. 5, when the user exercises and forces the left and right pedals 55 to move along the elliptical-like closed path T3, the first end portions 501 and the second end portions 502 of the left and right supporting members 50 respectively move along the first closed path T1 and the reciprocating path T2. Operation methods of an elliptical exercise apparatus are belong to prior art, such as disclosed in U.S. Pat. No. 5,540,637. Therefore, the methods are not described in detail herein.

In addition, the mechanical relationship among the left and right pedals 55, the left and right supporting members 50, and the left and right control links 65 of the embodiment can be changed as disclosed in U.S. Pat. No. 5,540,637. That is, the control link is directly pivoted to the supporting member to form as a pair of scissors. The pedal is directly connected to the rear portion of the control link. Therefore, the left and right pedals can still regularly change the angle relative to the corresponding left and right supporting member during exercise. And the pivot portion on the supporting member is equivalent to the space member in the present embodiment. Besides, a possible embodiment of the present invention may provide the user only a function of exercising his leg, i.e. the possible embodiment does not have the left and right handle links and the left and right control links. Left and right pedals in the possible embodiment may not change angle relative to left and right supporting members.

Figure 13:
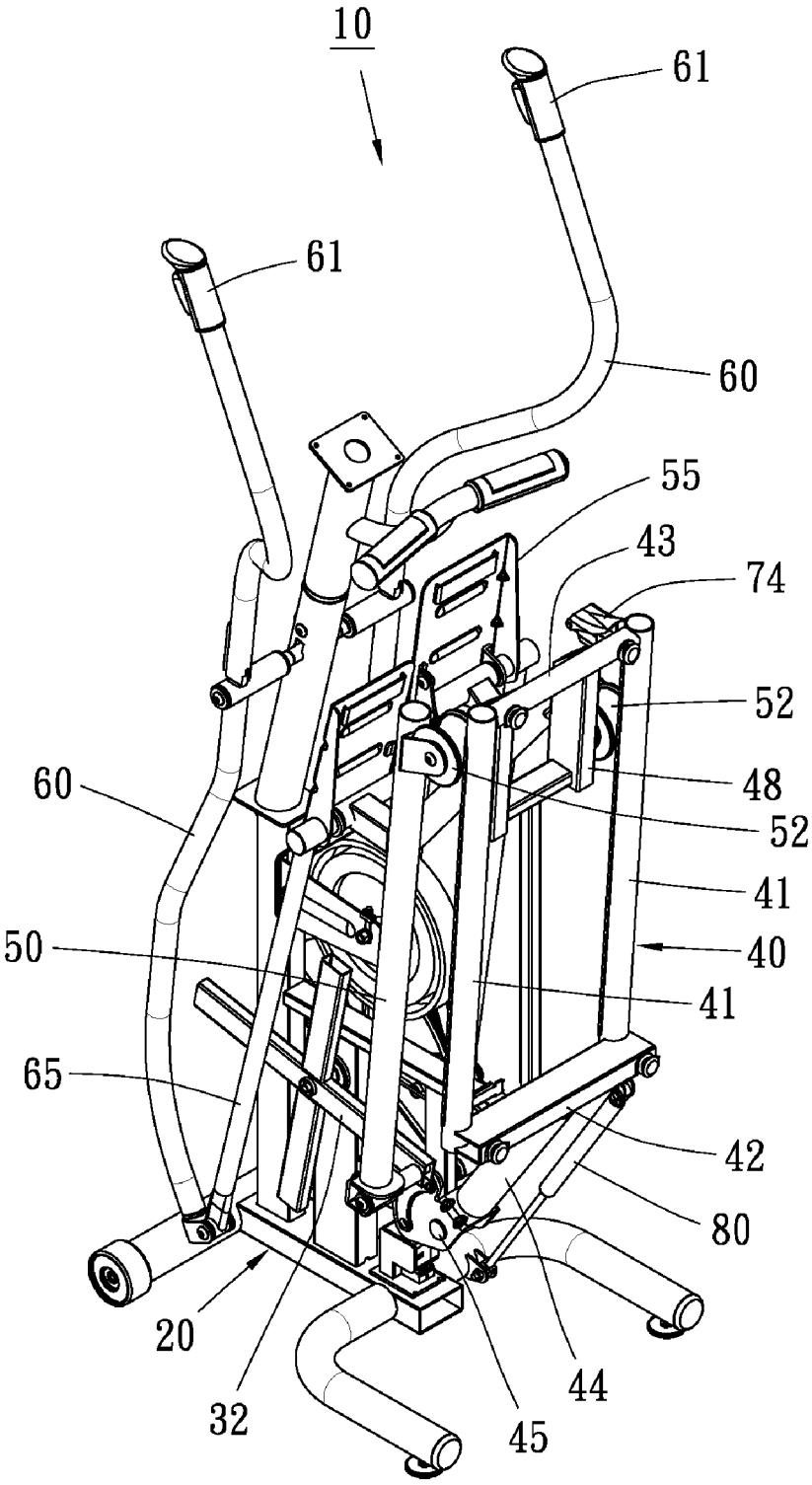
FIG. 13 is a perspective view of the folding elliptical exercise apparatus of FIG. 12.

When not in use, a user can fold up the elliptical exercise apparatus 10 into a status as depicted in FIG. 12 and FIG. 13. Generally, the folding process operated by the user is: (a) standing behind the elliptical exercise apparatus 10; (b) stooping down to turn the switch 74 by his right hand to pull the first pin 72 of the locking mechanism 70 out of the first locking hole 462; (c) gripping the rear rod 43 of the guider frame 40 by his left hand and lifting the guider frame 40 up; and (d) while the guider frame 40 is disengaged from the use position, the user can release the switch 74 and continue pushing the guider frame 40 until the first pin 72 of the locking mechanism 70 engages with the second locking hole 463. During the folding process, the left end of the first pin 72 of the locking mechanism 70 always in the arc groove 461 until the first pin 72 engages with the second locking hole 463.

Reversely, the unfolding process is: (a) turning the switch 74 by his right hand to disengage the guider frame 40 from the storage position; (b) gripping the rear rod 43 of the guider frame 40 by his left hand and pulling down the guider frame 40; and (c) waiting until the guider frame 40 rests on the ground surface and the first pin 72 of the locking mechanism 70 engages with the first locking hole 462.

In the first embodiment, as the user turning the switch 74 to pull the first pin 72 of the locking mechanism 70 rightward, the left end of the first pin 72 is still in the arc groove 461 but the left end of the first pin 72 is disengaged from the first locking hole 462 or the second locking hole 463. Therefore, the rotating range of the guider frame 40 is limited and the guider frame 40 can not be moved forward more, especially at the storage position.

Figure 11:
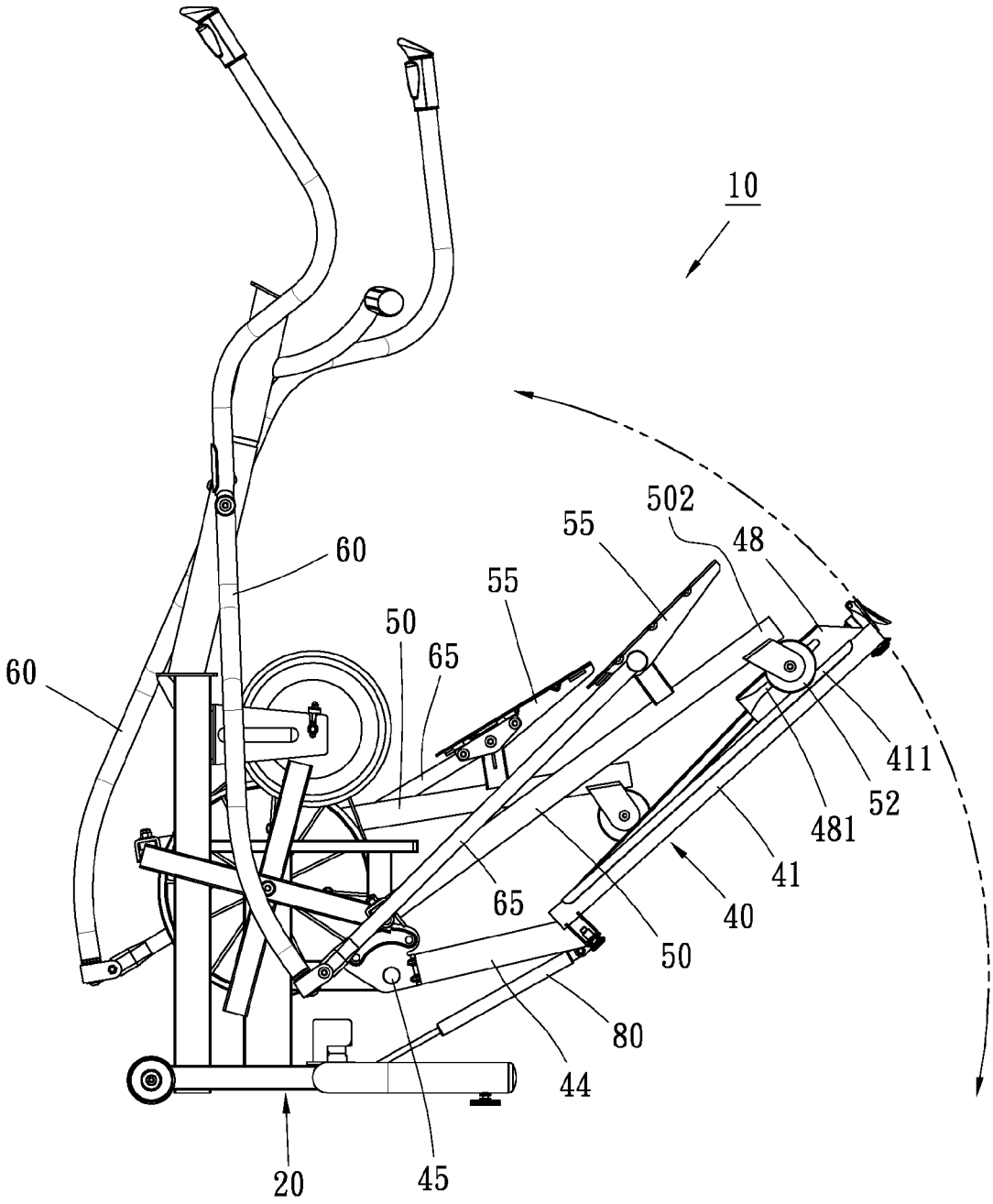
FIG. 11 is a left side view of the folding elliptical exercise apparatus which is at a status between the use and storage positions.

Referring to FIG. 11, there is a gas spring 80 interconnected between the front rod 42 of the guider frame 40 and the base 21 of the main frame 20. When the guider frame 40 is at the use position, the gas spring 80 is substantially horizontal and compressed. When the guider frame 40 is folded up to the storage position, the gas spring 80 is inclined and elongated. During the folding process, the gas spring 80 can help the user to lift up the guider frame 40 easier. On the contrary, during the unfolding process, the gas spring 80 can slow the descending speed and reduce the downward force.

Figure 3:
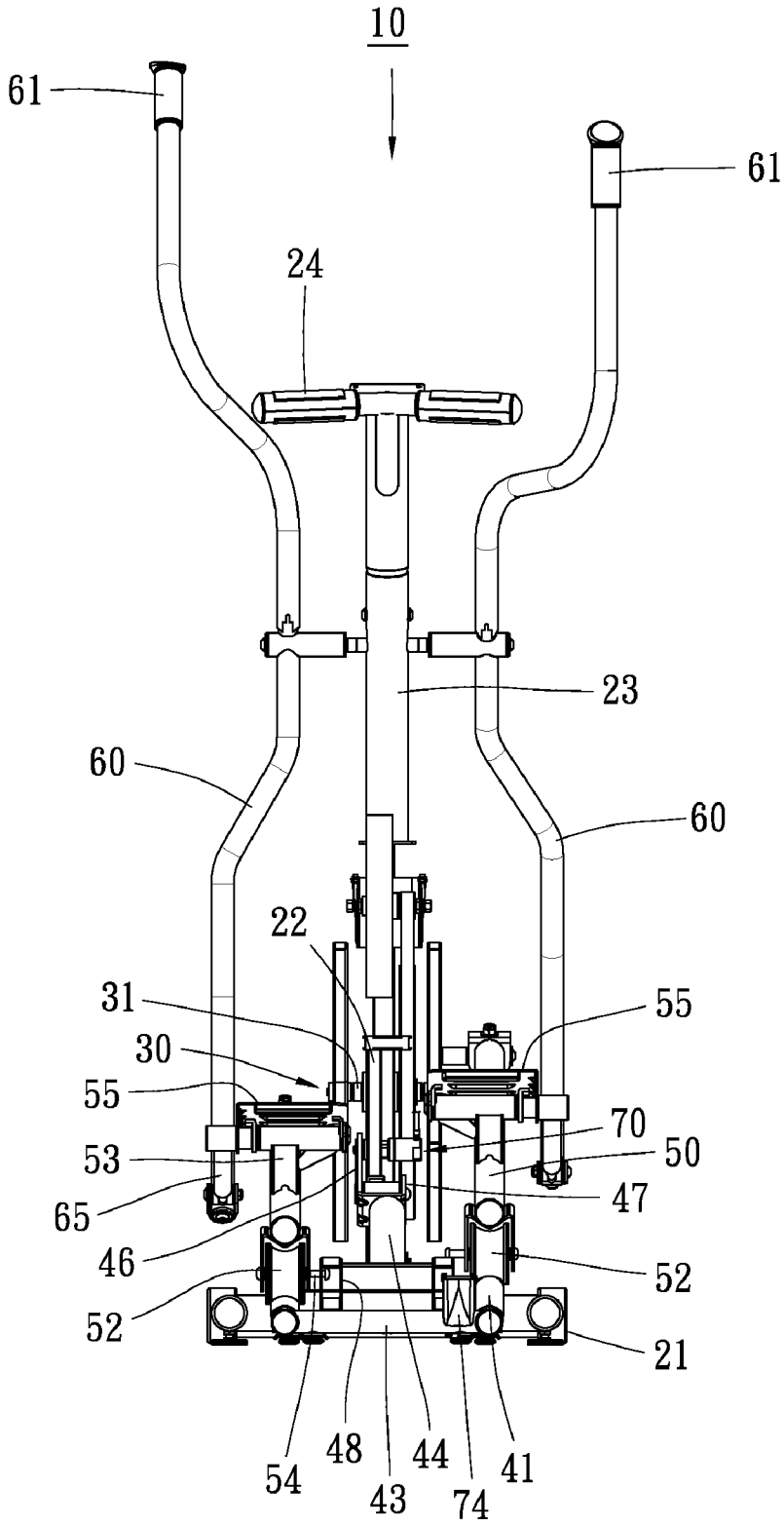
FIG. 3 is a back view of the folding elliptical exercise apparatus of FIG. 1.
Figure 10:
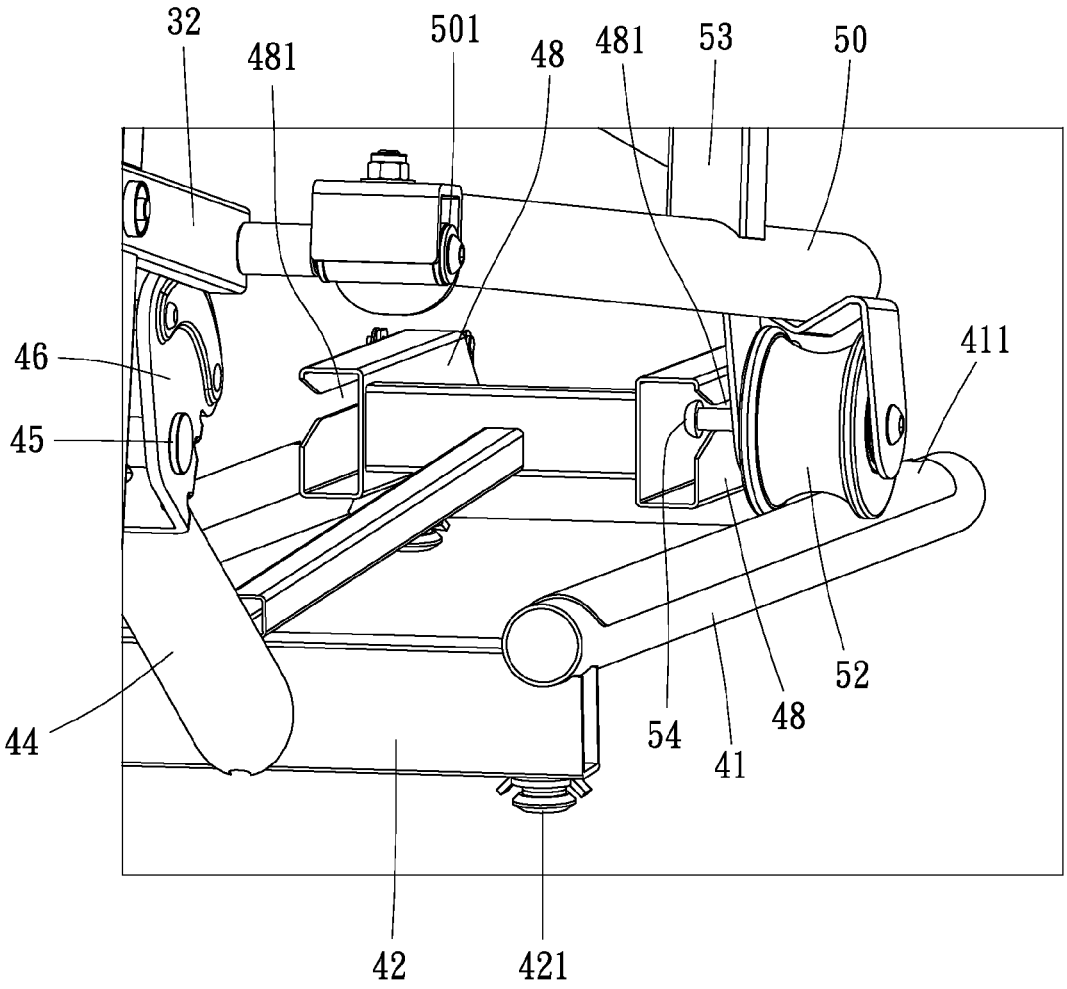
FIG. 10 is a partial perspective view of the folding elliptical exercise apparatus corresponding to FIG. 1.
Figure 14:
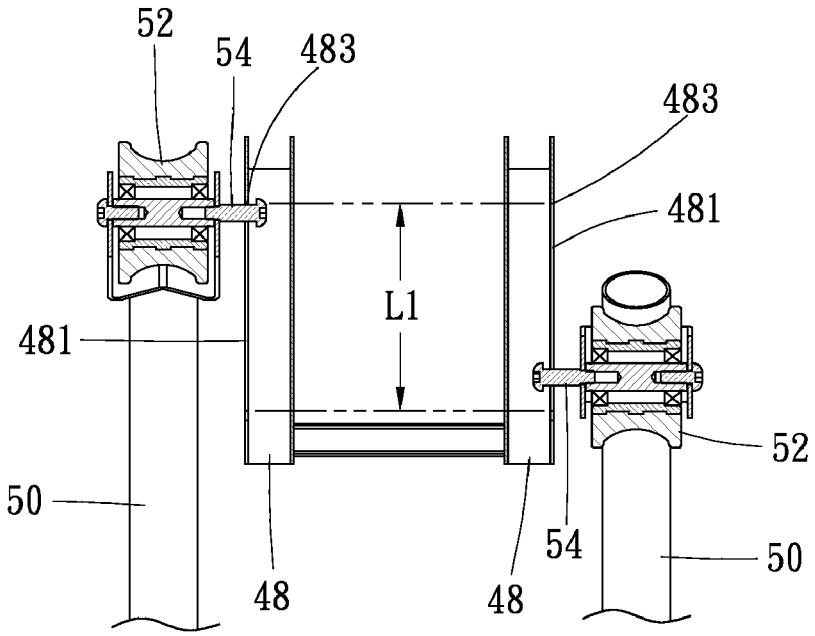
FIG. 14 is a cutaway view of the folding elliptical exercise apparatus about the II-II axis of FIG. 12.
Figure 16:
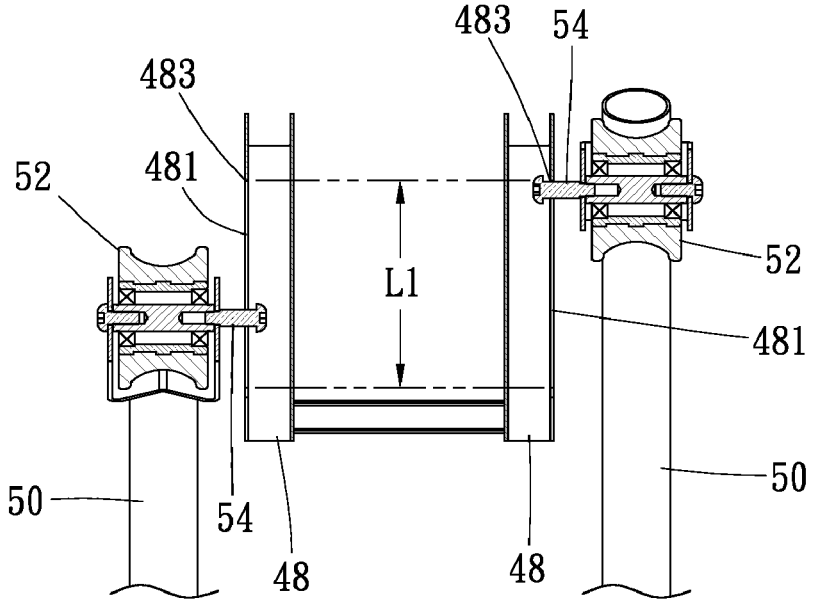
FIG. 16 is a cutaway view of the folding elliptical exercise apparatus about the III-III axis of FIG. 15.

Referring to FIG. 4 and FIG. 5, the left roller 52 connected to the second end portion 502 of the left supporting member 50 is at a second reciprocating end point P2 slightly above the left track 41 as shown in FIG. 4. And as shown in FIG. 5, the left roller 52 connected to the second end portion 502 of the left supporting member 50 is at a first reciprocating end point P1. Therefore, a distance between the first reciprocating end point P1 and the second reciprocating end point P2 is the length of the reciprocating path T2. That is, each of the left and right tracks 41 is at least required to have a length equal to the length of the reciprocating path T2, so that the left and right tracks 41 are capable of cooperating with the other mechanical parts of the elliptical exercise apparatus 10 to perform the elliptical-liked closed path T3 as mentioned above. However, each of the left and right tracks 41 of the embodiment in FIG. 4 further includes a supplemental section 411. The guider frame 40 correspondingly further includes left and right constraining members 48 which are respectively mounted inside the supplemental sections 411 of the left and right tracks 41 (FIG. 6). Each of the left and right constraining members 48 has a slot 481 disposed at the respective outer sides thereof. The left and right slots 481 parallel the supplemental sections 411 of the left and right tracks 41. Furthermore, each of the left and right slots 481 has an open front end 482 and a closed rear end 483. A length L1 of the left and right slots 481 (shown in FIG. 14) between the open front end 482 and the closed rear end 483 is shorter than half of the length of the reciprocating path T2. In the embodiment of FIG. 4, the length L1 is substantially about one third of the length of the reciprocating path T2. Besides, as shown in FIG. 3 and FIG. 10, there are second pins 54 respectively mounted on the center of the left and right rollers 52 which are disposed toward each other. When one of the left and right rollers 52 is moved at the corresponding second reciprocating end point P2 of the reciprocating path T2, the corresponding second pin 54 is substantially positioned at the open front end 482 of the corresponding slot 481.

Referring to FIG. 11, when the user folds up the guider frame 40 from the use position, the second end portions 502 of the left and right supporting members 50 are also lifted up by the guider frame 40. During the folding process of the embodiment in FIG. 11, the second end portions 502 of the left and right supporting members 50 move backward along the corresponding left and right tracks 41. The second end portions 502 of the left and right supporting members 50 then move over the respective second reciprocating end points P2 of the reciprocating path T2 and engage with the supplemental sections 411 of the left and right tracks 41 via the left and right rollers 52. As shown in FIG. 11, the second end portion 502 of the left supporting member 50 is right now above the left supplemental section 411 of the left track 41. Therefore, the second pin 54 mounted on the center of the left roller 52 is also driven into the left slot 481 of the left constraining member 48. As the guider frame 40 continuously being lifted up, the second end portion 502 of the left supporting member 50 keeps moving backward until the second pin 54 is stopped by the closed rear end 483 of the left slot 481. Once the second pin 54 is stopped by the closed rear end 483 of the left slot 481 at a terminal points $P_T$ (FIG. 4) which extends backward from the second reciprocating end point P2, the second end portion 502 of the left supporting member 50 can not be moved backward anymore and stays at a position corresponding to an actual rear end of the supplemental section 411 of the left track 41. Thus, the length L1 of the left and right slots 481 can also be regarded as the length of the supplemental sections 411 of the left and right tracks 41. Position of the actual rear ends of the supplemental sections 411 of the left and right tracks 41 is substantially consistent or aligned with the terminal point $P_T$. The second end portion 502 of the right supporting member 50 may also enters the supplemental section 411 of the right track 41 and keeps moving backward during the folding process. But, the second end portion 502 of the right supporting member 50 of the embodiment in FIG. 12 finally does not align with the second end portion 502 of the left supporting member 50 at the storage position. No matter which positions the left and right rollers 52 locate in before folding, the phenomena of the second end portions 502 of the left and right supporting members 50 mentioned above are substantially the same.

In the first embodiment, the user can fold up the elliptical exercise apparatus 10 as illustrated in FIG. 12. The user can also fold up the elliptical exercise apparatus 10 as the left and right supporting member 50 in reverse position with respect to FIG. 12, i.e. the second end portion 502 of the right supporting member 50 is in a position corresponding to the terminal point $P_T$. As depicted in FIG. 12, the crank unit 32 pivoted to the left and right supporting member 50 is substantially horizontal. In detail, the closed rear end 483 of the left slot 481 obstructs the left roller 52 first and then indirectly compels the right roller 52 to move backward during the folding process. As at the storage position, the left arm of the crank unit 32 pivoted to the left supporting member 50 is slightly decline and the left supporting member 50 is substantially vertical relative to the ground surface. The left roller 52 is stopped at the terminal point $P_T$. The right arm of the crank unit 32 pivoted to the right supporting member 50 is slightly raised and the right supporting member 50 is inclining. The right roller 52 is also at the supplemental section 411 of the right track 41 but is not at the terminal point $P_T$ thereof. The right roller 52 is lower than the left roller 52. Besides, the left and right control links 65 are hauled by the left and right supporting members 50 to position vertically. Because of the length of the slot 481, the effect of the constraining member 48 and the weights of the mechanical parts of the elliptical exercise apparatus 10, the left handle link 60 superimposes or aligns the right handle link 60 from the side view. As the elliptical exercise apparatus 10 being at the storage position, the guider frame 40, left and right supporting members 50, left and right pedals 55, left and right handle links 60, and left and right control links 65 are all within a space directly above the base 21 of the main frame 20. The occupied space of the elliptical exercise apparatus 10 at the storage position is therefore significantly reduced.

Referring to FIGS. 12 and 13, when the elliptical exercise apparatus 10 of the first embodiment is in the storage position, the guider frame 40 is locked by the locking mechanism 70 and pushed by the gas spring 80. The guider frame 40 can be fixed at the storage position. The second end portions 502 of the left and right supporting members 50 are neither moved upward nor moved forward to disengage from the left and right tracks 41, because the second pins 54 are in the respective slots 481 of the constraining members 48. In other possible embodiment, the constraining members may probably be optional if the incline degrees of the guider frame at the storage position do not approximate to vertical.

Figure 15:
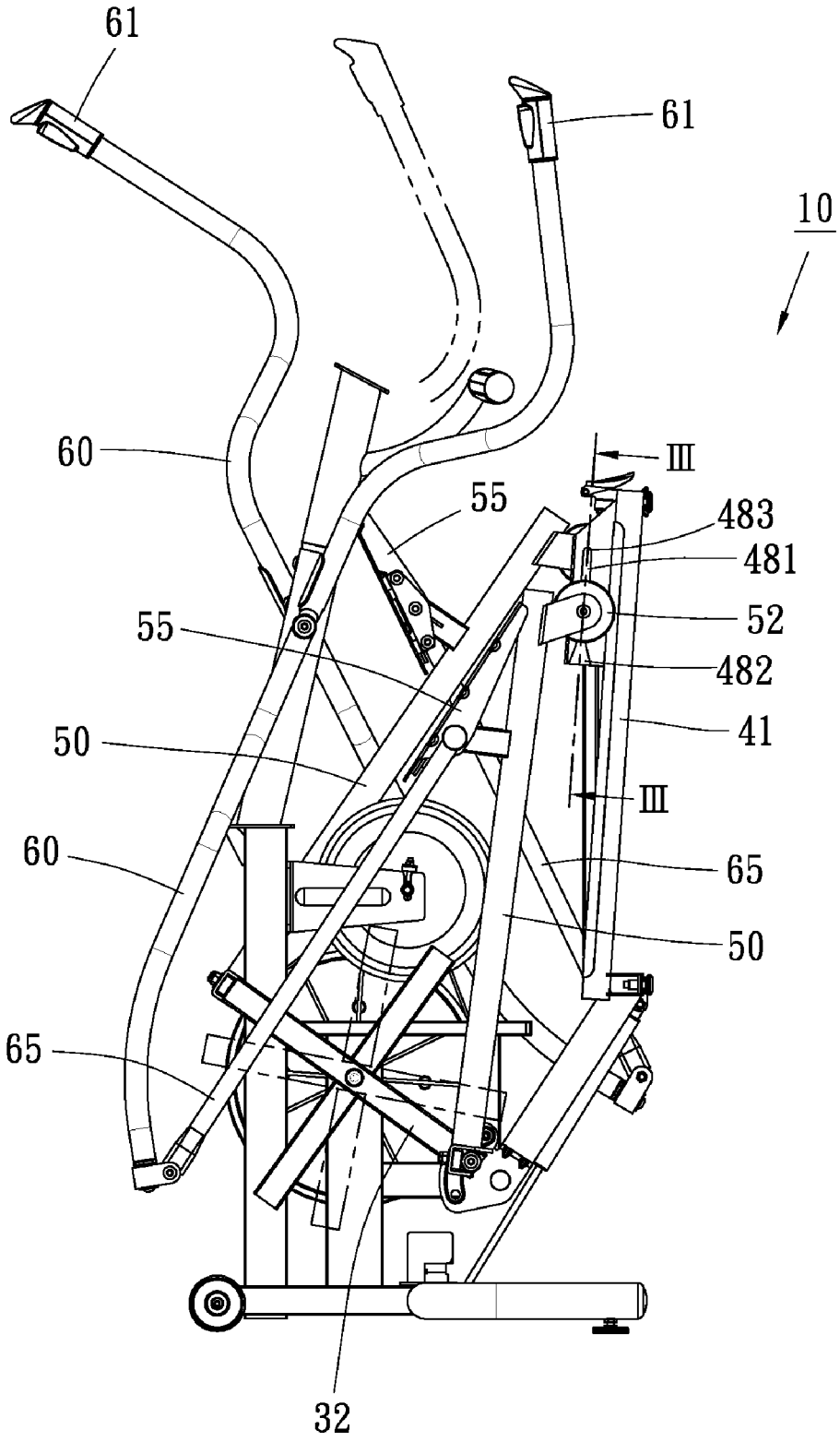
FIG. 15 is a left side view of the folding elliptical exercise apparatus wherein the crank thereof is at a position which can not be rotated clockwise.

As mentioned above, when the elliptical exercise apparatus 10 of the first embodiment is folded to the storage position, the mechanical parts of the elliptical exercise apparatus 10 naturally presents as shown in FIG. 12. However, the crank unit 32 and the left and right handle links 60 are not completely stationary. If the user forces the left handle link 60 or the right handle link 60 as the elliptical exercise apparatus 10 is at the storage position, the crank unit 32 and the left and right handle links 60 can still be moved. For example, if the user pulls back the left gripping portion 61 of the left handle link 60 and pushes forward the right gripping portion 61 of the right handle link 60 in FIG. 12, the left supporting member 50 is accordingly lowered and the right supporting member 50 is accordingly raised. The crank unit 32 is also correspondingly rotated clockwise as shown in FIG. 15. When the right supporting member 50 is raised, the right roller 52 is driven to move up along the supplemental section 411 of the right track 41 and the second pin 54 mounted on the right roller 52 is finally stopped at the closed rear end 483 of the right slot 481. Besides, as depicted in FIG. 15, the crank unit 32 is at an unstable status and has a trend to rotate to horizontal. When the user releases the left and right handle links 60, the crank unit 32 spontaneously rotates counterclockwise and returns to the status as shown in FIG. 12.

Figure 17:
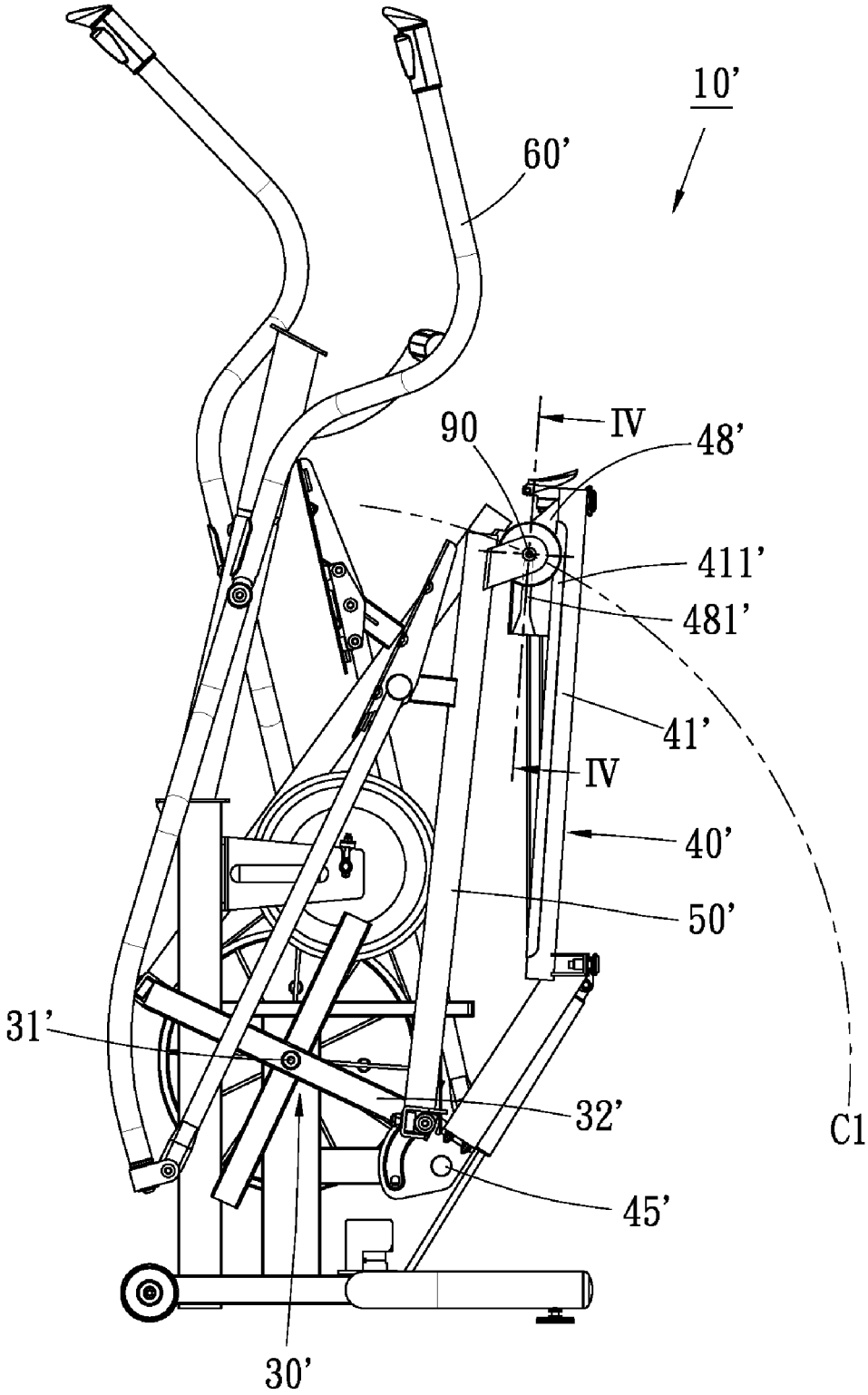
FIG. 17 is a left side view of a second embodiment of a folding elliptical exercise apparatus of the present invention.
Figure 18:
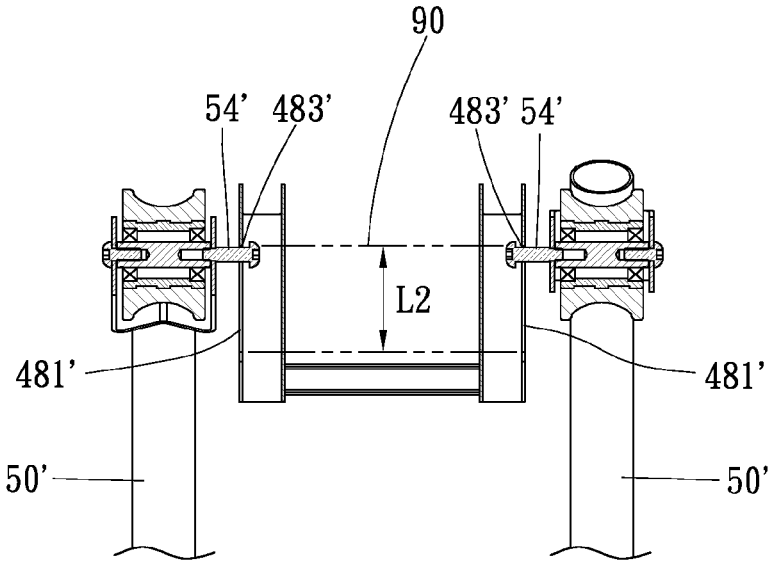
FIG. 18 is a cutaway view of the folding elliptical exercise apparatus of the second embodiment about the IV-IV axis of FIG. 17.

Referring to FIG. 17, an elliptical exercise apparatus 10' of a second embodiment of the present invention is illustrated therein. The most mechanical parts in the second embodiment are the same with the first embodiment of FIGS. 11 and 12. However, a length L2 of supplemental sections 411' of left and right tracks 41', constraining members 48', and left and right slots 481' of the constraining members 48' of the second embodiment are shorter than the first embodiment. In the second embodiment, when the guider frame 40' is lifted up from the use position to the storage position via the pivot axis 45' which is coupled to the rack 22' at a position same with the first embodiment, two second pins 54' of left and right rollers 52' are aligned and both stopped at closed rear ends 483' of the left and right slots 481' as illustrated in FIG. 18. When the two second pins 54' are both stopped at a terminal point $P_T'$ (not shown), a crank assembly 30' can not be rotated at the storage position. Therefore, all mechanical parts of the second embodiment are substantially immovable as depicted in FIG. 17. Comparing FIG. 14 with FIG. 18, the length L2 of the left and right slots 481' in the second embodiment is shorter than the length L1 of the left and right slots 481 in the first embodiment. Comparing FIG. 12 with FIG. 17, the length of the supplemental section 411' of the left and right tracks 41' of the second embodiment is shorter than the length of the supplemental section 411 of the left and right tracks 41 of the first embodiment. Thus, the length of the left and right tracks 41' can be significantly shorten in the second embodiment. This can contribute to further reduce the floor space of the elliptical exercise apparatus 10' at the use position.

Figure 20:
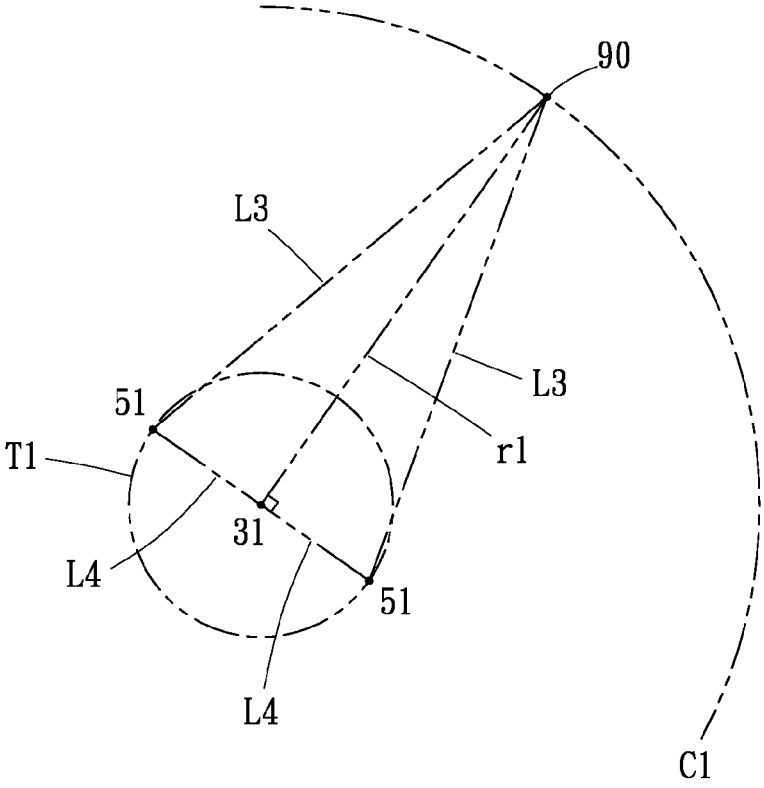
FIG. 20 is a schematic diagram which shows relationship among length of a crank, length of a supporting member, and the minimal periphery.
Figure 19A:
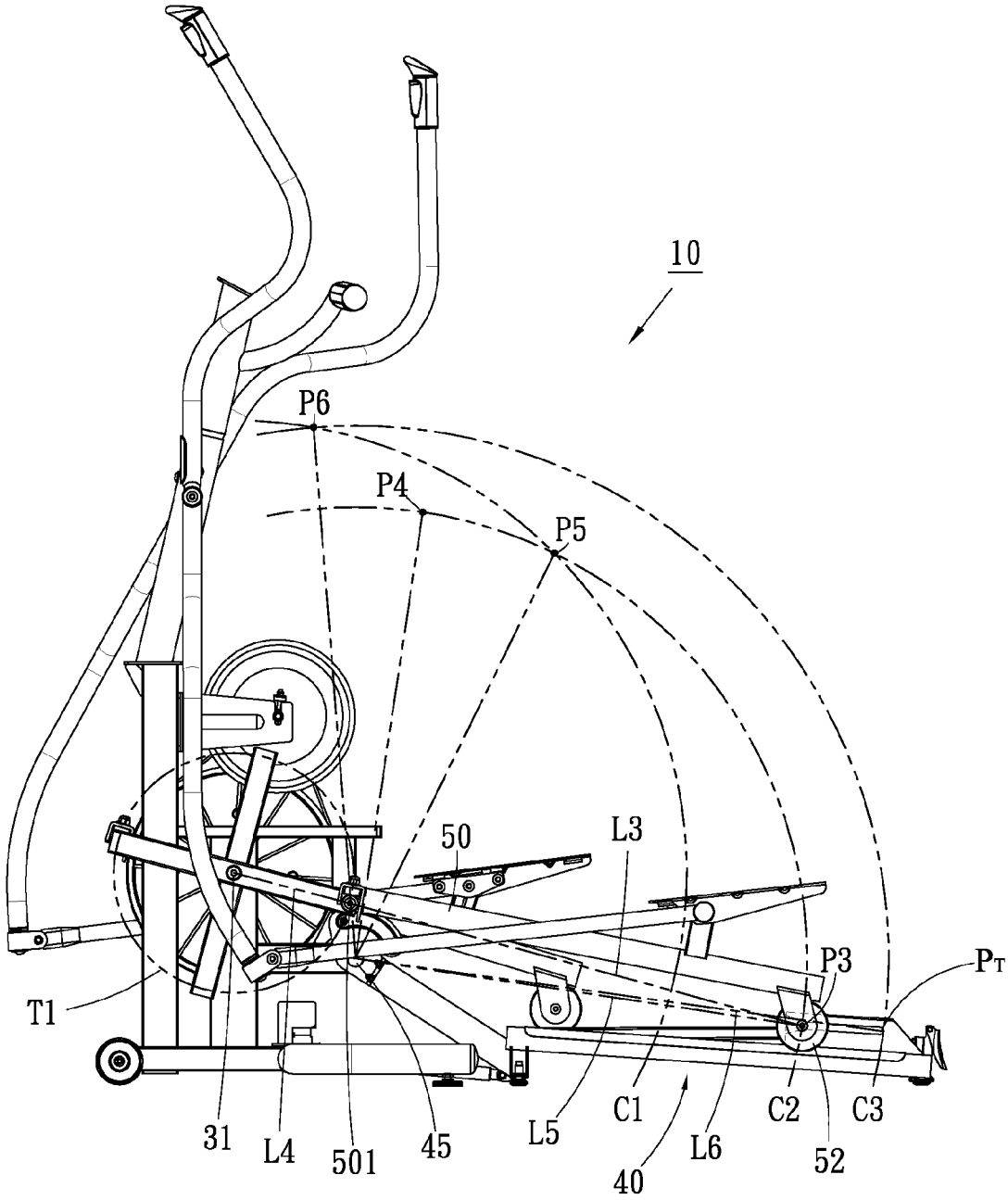
FIG. 19*a* is a left side view of the elliptical exercise apparatus of the first embodiment which shows relationship among a minimal periphery, a second periphery, and a third periphery.

Under certain condition and limitation, an elliptical exercise apparatus of the current invention can be folded at a proper storage position even without any supplemental section of the track. The position of the pivot axis of the guider frame mainly plays the role under such situation. The first embodiment of FIG. 4 is taken for further explanation. Besides, the elliptical exercise apparatus 10 of the first embodiment depicted in FIG. 19*a* is the same with FIG. 4. Referring to FIG. 19*a*, a length from the first end portion 501 of the left supporting member 50 to the second end portion 502 of the left supporting member is defined as a linking length L3. More specifically, the linking length L3 is measured from the pivot point of the first end portion 501 to the center of the left roller 52. A length from the pivot point of the first end portion 501 of the left supporting member 50 to the first axis 31 is defined as a rotating radius L4. The rotating radius L4 can also be regarded as the length of the arm of the crank unit 32. FIG. 20 is a simplified sketch showing that the second end portions 502 of the left and right supporting members 50 are able to align at an aligned axis 90 and constitute a minimal periphery C1. More details are described hereinafter. In FIG. 20, the rotating radius L4 represents the arm of the crank unit 32. The two linking length L3 respectively represent the left and right supporting members 50. The second end portions 502 thereof are superimposed together to form the aligned axis 90 which is perpendicular to the plane of the page. A length from the aligned axis 90 to the first axis 31 is an aligned radius r1 which is the radius of the minimal periphery C1. An example of the aligned axis 90 is a fictitious line as shown in FIG. 18 which is occurred when the second pins 54' of the left and right rollers 52' become aligned. Referring to FIGS. 19*a* and 20, the minimal periphery C1 is a periphery centered at the first axis 31 and paired with the aligned radius r1. Besides, the linking length L3, the rotating radius L4, and the aligned radius r1 form a right triangle. Therefore, the length of the aligned radius r1 can be calculated by using Pythagorean theorem.

Figure 19B:
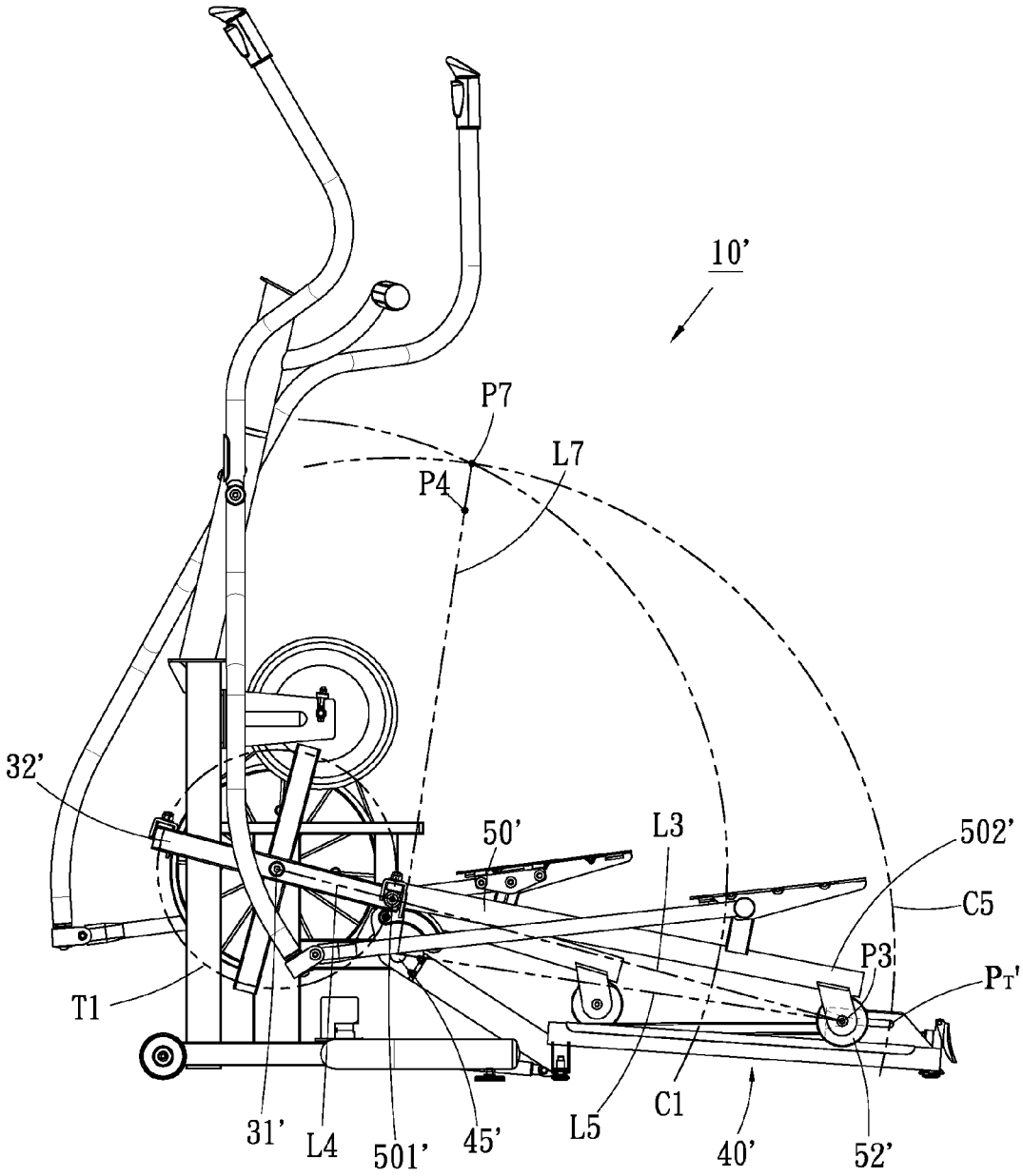
FIG. 19*b* is a left side view of the elliptical exercise apparatus of the second embodiment which shows relationship among a minima periphery, a second periphery, and a fifth periphery.

The minimal periphery C1 represents the positions of the aligned axis 90 when the aligned second end portions 502 of the left and right supporting members 50 are lifted up at different angles. Please refer to the second embodiment of the current invention as shown in FIGS. 17 and 19*b* for example. If the left and right supporting members 50' in FIG. 19*b* are respectively moved forward and backward, the second end portions 502' would eventually align at a position which is on the minimal periphery C1. As shown in FIG. 17, the aligned axis 90 representing the aligned second end portions 502' of the left and right supporting members 50' is also on the minimal periphery C1 when the elliptical exercise apparatus 10' is at the storage position. These are two examples illustrated showing that the minimal periphery C1 represents the positions of the aligned axis 90 at different angles. Please further refer to FIG. 19*b* for more explanation of the current invention. A fifth periphery C5 is defined by the pivot axis 45' as the center and a fifth radius L7 which is the distance from the pivot axis 45' to the terminal point $P_T'$ or the closed rear ends 483' of the left and right slot 481'. The fifth periphery C5 represents the positions of the closed rear ends 483' when the guider assembly 40' is lifted up at different angles. When the user lifting the guider frame 40' to the storage position as shown in FIG. 17, the second pins 54' of the left and right rollers 52' are also blocked by the closed rear ends 483' of the left and right slots 481'. Meanwhile, the fifth periphery C5 and the minimal periphery C1 are intersected at a point P7 as shown in FIG. 19*b*. Generally, an intersecting potion between the minimal periphery C1 and a periphery represents a storage position where aligned second end portions of left and right supporting members are both blocked or stopped by closed rear ends. In FIG. 17, because the aligned second end portions 502' are both stopped by the closed rear ends 483', the left and right supporting members 50' both can not be moved forward or backward any more. The crank assembly 30' is also unmovable.

Referring to FIG. 19*a*, the guider frame 40 and the pivot axis 45 define a second periphery C2 and a third periphery C3. Let's look at the details of the second periphery C2 first. The second periphery C2 is centered at the pivot axis 45 and paired with a second radius L5 which is the distance between the pivot axis 45 and the second reciprocating end point P2 of the reciprocating path T2. The second periphery C2 represents a rotating path of the second reciprocating end point P2 of the reciprocating path T2 (FIG. 4) as the guider frame 40 being lifted up. A start position P3 is the position of the second reciprocating end point P2 when the guider frame 40 is at the use position and a final position P4 is the position of the second reciprocating end point P2 when the guider frame 40 of the embodiment of FIG. 19*a* is at the storage position. The included or lifting angle from the start position P3 along the second periphery C2 to the final position P4 is about ninety degrees. As depicted in FIG. 19*a*, the second periphery C2 and the minimal periphery C1 are intersected at a first intersection point P5. A first lifting angle from the start position P3 along the second periphery C2 to the first intersection point P5 is about seventy-two degrees. It means that even without the supplemental sections 411 of the left and right tracks 41 of the first embodiment, the guider frame 40 can still be elevated up to a storage position which is more than sixty degrees. More importantly, the left and right supporting members 50 can be lifted up simultaneously and both sill be supported by the left and right tracks 41, which do not need any supplemental sections. If the guider frame 40 can be lifted up more than sixty degrees from a substantially horizontal use position, it means that the projected longitudinal length (from top view) of the guider frame 40 on the ground surface can be reduced more than half. According to the current invention, an embodiment without any supplemental sections of the tracks occupies the least space at the use position and can reduce significant space when the guider frame is at the storage position.

In the first and second embodiments, the reason that the lifting angle is about ninety degrees and the left and right tracks 41, 41' still support the left and right supporting members 50, 50' is that both the embodiments are equipped with the supplemental sections 411, 411'. But the lengths of the supplemental sections 411, 411' are both smaller than the rotating radius L4. The length of the supplemental sections 411 is about one-third of the length of the reciprocating path T2 and the length of the supplemental sections 411' is shorter than one-third of the length of the reciprocating path T2. Referring to FIG. 19*a*, a third periphery C3 which is centered at the pivot axis 45 and paired with a third radius L6 which is the distance from the pivot axis 45 to the terminal point $P_T$ or the closed rear end 483 of the slot 481. The longer slots 481 or the longer supplemental sections 411 of the track 41 result that the minimal periphery C1 and the third periphery C3 are intersected at a second intersection point P6 which is in front of the point P7 in FIG. 19*b*. That is, if there is no locking mechanism 70, the guider frame 40 can be lifted up 102 degrees until the aligned axis 90 is positioned on the minimal periphery C1. But, the locking mechanism 70 stops the guider frame 40 at about 90 degrees. Please refer to FIGS. 12 and 17 for the reasoning. In FIG. 17, the left and right handle links 60' are not aligned (from a side view) and not movable any more because of the shorter supplemental sections 411'. From a product perspective, the first embodiment of FIG. 12 looks more concise from a side view of the exercise apparatus 10 because the left and right handle links 60 are substantially aligned. The reason is that the first embodiment of FIG. 12 has longer supplemental section 411 which allows the second end portion 502 of the left supporting member 50 to move further upward. This causes the left handle link 60 to move forward and eventually align with the right handle link 60 which is moved backward correspondingly.

Figure 21:
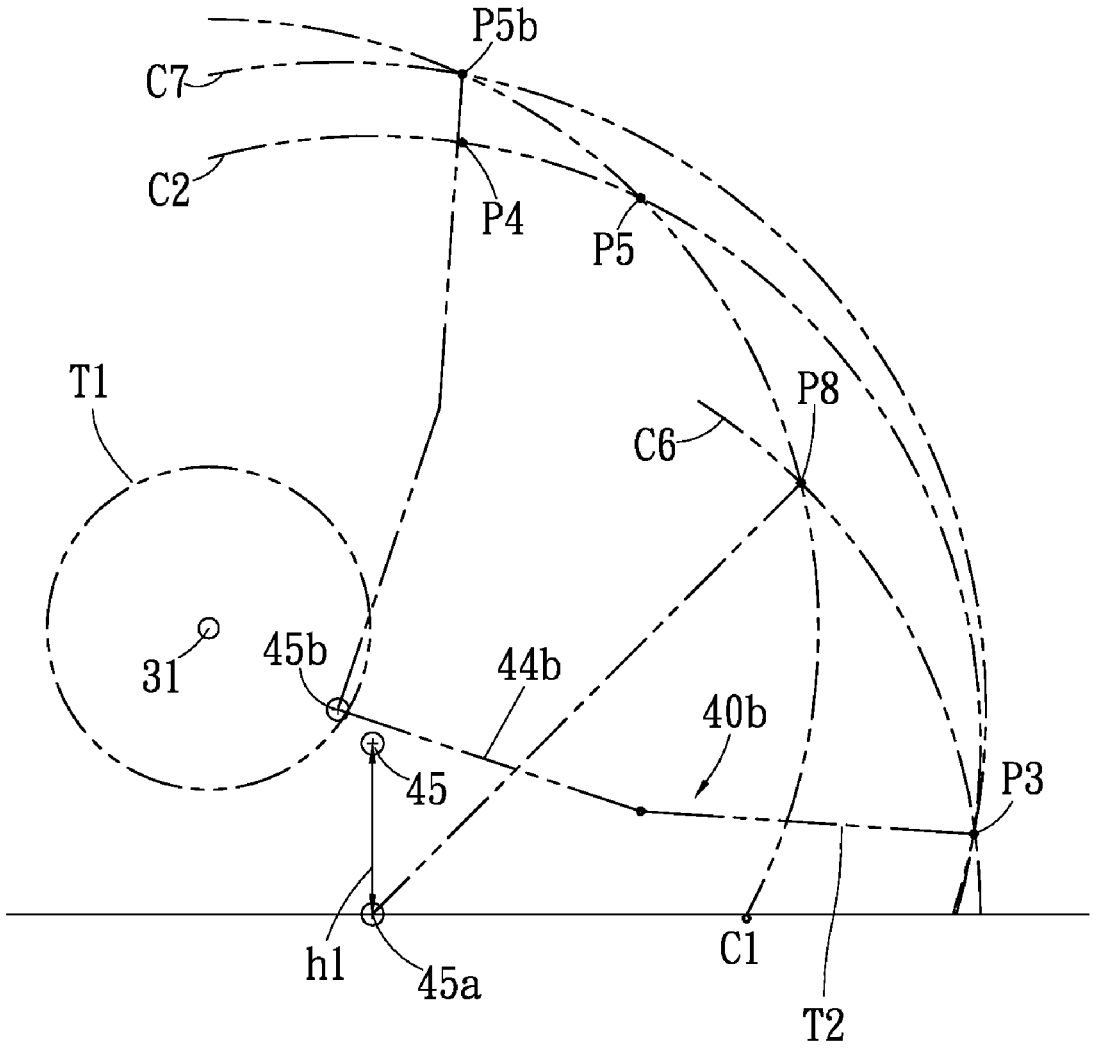
FIG. 21 is a schematic diagram of a folding elliptical exercise apparatus of a third embodiment.

If the length of the supplemental sections of the tracks is the only parameter, a better lifting angle can be achieved by increasing the length of the supplemental sections. But, the correspondent drawback of increasing the length of the supplemental sections of the tracks is increasing of the occupied space of an exercise apparatus at the use position. The current invention discloses a theory which can achieve a proper lifting angle without increasing any supplemental sections of the tracks or achieve a lifting angel more than 80 degrees, approximate 90 degrees, by adding a limited length of the supplemental sections of the tracks. The position of the pivot axis 45 of the guider frame 40 plays an important role. More specifically, a better lifting angle could be achieved by carefully selecting different positions of the pivot axis 45, 45'. Referring to FIG. 21 which is a simplified sketch for demonstrating the theory of the current invention, the pivot axis 45 of the guider frame 40 is located at the first height h1 which is a vertical height relative to the base 21. The arrangement of the pivot axis 45 in FIG. 21 is same with the first embodiment of FIG. 19*a*. Before further explaining the current invention, some mechanism of prior art could be discussed first. A sixth periphery C6 is centered at a pivot axis 45*a* and paired with a radius from the pivot axis 45*a* to the start position P3 of the second reciprocating end point P2 of the reciprocating path T2. The sixth periphery C6 and the minimal periphery C1 soon are intersected at a point P8. In this situation, the left and right rollers are soon stopped during the folding process and a lifting angle is only thirty-eight degrees. A lifting angle is forty-five degrees when further lowering the second reciprocating end point to a height the same with the pivot axis 45*a*. The characteristic of the pivot axis 45*a* is that it is not elevated a first height relative to the base 21. And, the pivot axis 45*a* is located behind the rear edge of the first closed path T1. In order to make the lifting angle achieve about ninety degrees, left and right tracks of an elliptical exercise apparatus in this prior art embodiment have to add a significantly long supplemental sections. However, the elliptical exercise apparatus of this situation will become too space consuming at the use position. On the contrary, positions of the pivot axis can be appropriately adjusted to increase the lifting angle without significantly increasing the length of left and right tracks of an elliptical exercise apparatus.

As illustrated in FIG. 4 and FIG. 21, the position of the pivot axis 45 is higher than the first and second reciprocating end points P1, P2 of the reciprocating path T2. The first height h1 of the pivot axis 45 is higher than the bottom edge of the first closed path T1 and the position thereof is close to the rear edge of the first closed path T1. In addition, the length of the first height h1 in the first and second embodiments is greater than two thirds of the magnitude of the rotating radius L4. Because of the position of the pivot axis 45 and the properly selected supplemental sections 411, the elliptical exercise apparatus 10 can be folded at the storage position as shown in FIG. 12. The lifting angle is about ninety degrees and the left and right handle links 60 are substantially aligned. FIG. 12 also depicts that the pivot axis 45 is nearer to the first end portion 501 of the left supporting member 502 than to the base 21 of the main frame 20 when the guider frame 40 is at the storage position. One interest situation happens when the pivot axis 45 overlaps the pivot point of the first end portion 501 of the left supporting member 502 at the storage position as shown in FIG. 12.

Referring to FIG. 21, the third embodiment of the present invention is illustrated therein. In order to succinctly explain the relationship among the third embodiment and previous embodiments, tangible structures of the elliptical exercise apparatus of the third embodiment are omitted. In the third embodiment, positions of the first axis 31, the first closed path T1, the length of the reciprocating path T2, and the minimal periphery C1 are all the same with the first and second embodiments. However, the third embodiment has a new pivot axis 45*b* with different position from the original position of the pivot axis 45. The pivot axis 45*b* is located at a position which is exactly overlapped with the pivot point of the first end portion 501 of the left supporting member 502 at the storage position. In the third embodiment, the arm 44 of the first embodiment is accordingly elongated and adjusted to become an arm 44*b*. Furthermore, left and right tracks in the third embodiment are not equipped with supplemental sections. Therefore, the second reciprocating end point P2 of the reciprocating path T2 and terminal points are at the same position when the elliptical exercise apparatus is in the use position. A seventh periphery C7 is centered at the pivot axis 45*b* and paired with a seventh radius L8 which is a length or distance from the pivot axis 45*b* to a start position P3 which is the position of the second reciprocating end point P2 at the use position. The second reciprocating end points of the current embodiments are all superimposed at the start position P3. Thus, the seventh periphery C7 is similar to the second periphery C2. The seventh periphery C7 and the minimal periphery C1 are intersected at an intersection point P5*b* which locates substantially above the final position P4 of the first and second embodiments. The intersection point P5*b* and the start position P3 have an angle of ninety degrees which is greater than the lifting angle created by the first intersection point P5. Although the left and right tracks are not equipped with the supplemental sections, the third embodiment can still provide substantially the same folding status for a user by an alternative position of the pivot axis 45*b*. Although there is no constraining member in the third embodiment. People skilled in the art can easily mount equivalent structures to achieve substantially the same result as the constraining member 48, 48' in the first and second embodiments.

Figure 22:
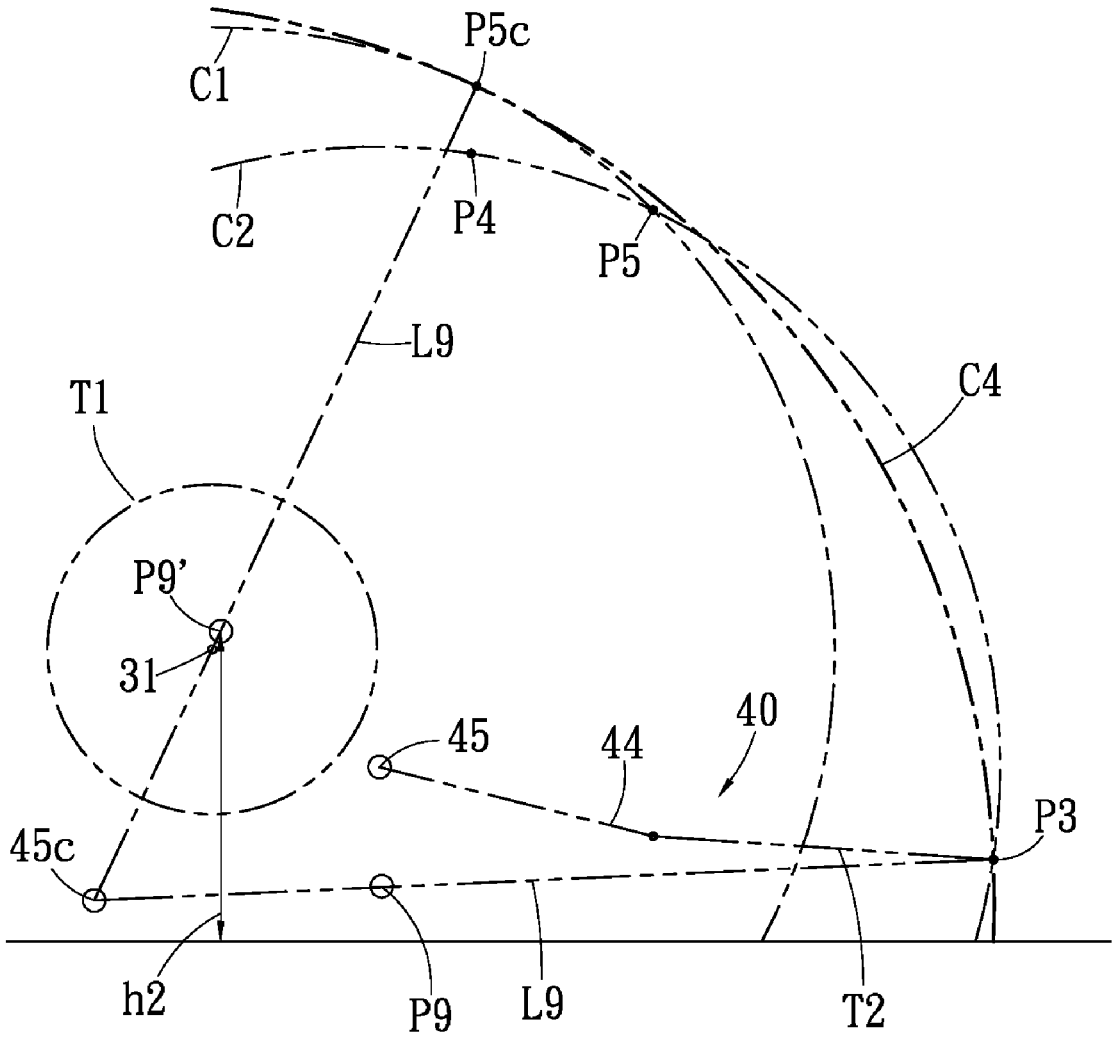
FIG. 22 is a schematic diagram of a folding elliptical exercise apparatus of a fourth embodiment.

FIG. 22 illustrates a fourth embodiment of the present invention. In the fourth embodiment, the first axis 31, the first closed path T1, the length of the reciprocating path T2, and the minimal periphery C1 are all the same with the first and second embodiments. The fourth embodiment has a new pivot axis 45*c* located much front and lower relative to the pivot axis 45. The arm 44 of the first embodiment is accordingly elongated and adjusted. An elliptical exercise apparatus of the fourth embodiment is also not equipped with supplemental sections. The pivot axis 45*c* is close to the ground surface but in front of the first axis 31. A fourth periphery C4 is centered at the pivot axis 45*c* and paired with a fourth radius L9 which is a length or distance from the pivot axis 45*c* to the start position P3. Thus, the fourth periphery C4 is similar to the second periphery C2. There is an intermediate point P9 on the guider frame located between the pivot axis 45*c* and the start position P3. The position of the intermediate point P9 is also substantially and vertically aligned with the rear edge of the first closed path T1.

During the folding process of the fourth embodiment, the second reciprocating end points are moved from the start position P3 and along the fourth periphery C4. The fourth periphery C4 and the minimal periphery C1 are intersected at a third intersection point P5*c* which locates substantially over the final position P4 of the first and second embodiments. In the fourth embodiment, the arc of the fourth periphery C4 between the start position P3 and the third intersection point P5*c* has a third lifting angle which is about sixty-two degrees. Besides, the intermediate point P9 is elevated at a second height h2 relative to the base 21 of the main frame 20 and located at a position P9'. The position P9' is much closer to the first axis 31 than the base 21 of the frame 20 and located above the bottom edge of the first closed path T1. Therefore, the second height h2 is longer than the rotating radius L4.

The present invention does not require that all the advantageous features and all the advantages need to be incorporated into every embodiment thereof. Although the present invention has been described in considerable detail with reference to certain preferred embodiment thereof, other embodiments are possible. While the present invention has been described in terms of certain preferred embodiments, one of ordinary skill in the art of the invention will recognize that additions, deletions, substitutions, modifications and improvements can be made while remaining within the scope and spirit of the invention as defined by the attached claims.

What is claimed is:

1. An elliptical exercise apparatus, comprising:

(a) a main frame having a base;

(b) first and second supporting members, each supporting member having a first end portion and a second end portion, the first end portions of the supporting members respectively coupled to the main frame to rotate about a first axis around a first closed path, the second end portions of the supporting members being able to align at an aligned axis, and a minimal periphery defined by the first axis and an aligned radius which is the distance between the first axis and the aligned axis;

(c) a guider frame pivotally connected to the main frame at a pivot axis to be movable between a use position and a storage position, the guider frame respectively having a track for supporting the second end portion of the respective supporting member at both the use and storage positions, the second end portion of the respective supporting member movable on the track within first and second reciprocating end points of a reciprocating path while the guider frame is at the use position, the track of the guider frame including a supplemental section extending from the second reciprocating end point to a terminal point, the magnitude of the supplemental section being smaller than the magnitude of a rotating radius which is defined by the first axis and first closed path, a second periphery being defined by the pivot axis and a second radius which is the distance between the pivot axis and the second reciprocating end point and a third periphery being defined by the pivot axis and a third radius which is the distance between the pivot axis and the terminal point, the minimal periphery and the second periphery intersected at a first intersection point located above the track of the guider frame, the minimal periphery and the third periphery intersected at a second intersection point located above the track of the guider frame wherein the pivot axis of the guider frame is located at a first height higher than the bottom edge of the first closed path, an arc of the second periphery between the first intersection point and the second reciprocating end point at the use position has a first lifting angle which is greater than sixty degrees, and an arc of the third periphery between the second intersection point and the terminal point at the use position having a second lifting angle which is greater than eighty degrees; and (d) first and second pedals respectively coupled to the first and second supporting members.

2. The elliptical exercise apparatus of claim 1, wherein the pivot axis is located to be nearer to the first end portion of one of the supporting members than the base of the main frame when the guider frame is at the storage position.

3. The elliptical exercise apparatus of claim 1, wherein the first height is greater than two thirds of the magnitude of the rotating radius.

4. The elliptical exercise apparatus of claim 1, wherein the second radius at the first intersection point has a projective length on the surface where the base of the main frame rests on and the projective length is less than fifty percent of the second radius.

5. An elliptical exercise apparatus, comprising:

(a) a main frame having a base;

(b) first and second supporting members, each supporting member having a first end portion and a second end portion, the first end portions of the supporting members respectively coupled to the main frame to rotate about a first axis around a first closed path, the second end portions of the supporting members being able to align at an aligned axis, and a minimal periphery defined by the first axis and an aligned radius which is the distance between the first axis and the aligned axis;

(c) a guider frame pivotally connected to the main frame at a pivot axis to be movable between a use position and a storage position, the guider frame respectively having a track for supporting the second end portion of the respective supporting member at both the use and storage positions and having a constraining member with an open front end and a closed rear end, the second end portion of the respective supporting member movable on the track within first and second reciprocating end points of a reciprocating path while the guider frame is at the use position, the track of the guider frame including a supplemental section extending from the second reciprocating end point to a terminal point, the magnitude of the supplemental section being smaller than the magnitude of a rotating radius which is defined by the first axis and first closed path, a second periphery being defined by the pivot axis and a second radius which is the distance between the pivot axis and the second reciprocating end point, the minimal periphery and the second periphery intersected at a first intersection point located above the track of the guider frame wherein the pivot axis of the guider frame is located at a first height relative to the base, an arc of the second periphery between the first intersection point and the second reciprocating end point at the use position has a first lifting angle which is greater than sixty degrees, and the constrain member is located at the terminal point for stopping one of the second end portions of the supporting members when the guider frame is folded up to the storage position; and (d) first and second pedals respectively coupled to the first and second supporting members.

6. The elliptical exercise apparatus of claim 5, further comprising first and second handle links pivotally coupled to the main frame and first and second control links coupled between the respective handle links and the pedals, the first and second handle links being substantially aligned from a side view of the stationary exercise apparatus when the guider frame is at the storage position.

* * * * *